US011835906B2

(12) United States Patent
Mori et al.

(10) Patent No.: US 11,835,906 B2
(45) Date of Patent: Dec. 5, 2023

(54) FOIL TRANSFER DEVICE

(71) Applicant: BROTHER KOGYO KABUSHIKI KAISHA, Nagoya (JP)

(72) Inventors: Kentaro Mori, Nagoya (JP); Ryosuke Sakai, Nagoya (JP); Ayaka Ohira, Nagoya (JP); Tomoya Yamamoto, Nagoya (JP); Seiji Hiramatsu, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 60 days.

(21) Appl. No.: 17/704,514

(22) Filed: Mar. 25, 2022

(65) Prior Publication Data

US 2022/0214639 A1 Jul. 7, 2022

Related U.S. Application Data

(63) Continuation of application No. PCT/JP2020/035207, filed on Sep. 17, 2020.

(30) Foreign Application Priority Data

Sep. 26, 2019 (JP) ..... 2019-175554
Jan. 29, 2020 (JP) ..... 2020-012595

(51) Int. Cl.
*G03G 15/01* (2006.01)
*G03G 15/00* (2006.01)
*B44C 1/17* (2006.01)

(52) U.S. Cl.
CPC ..... *G03G 15/6582* (2013.01); *B44C 1/1716* (2013.01)

(58) Field of Classification Search
CPC ..... G03G 15/01; G03G 15/01665; G03G 15/6582; B44C 1/1716
(Continued)

(56) References Cited

U.S. PATENT DOCUMENTS 9,037,065 B2 * 5/2015 Suzuki ..... G03G 15/16 430/126.1
2008/0196662 A1 8/2008 Reschke et al.
(Continued)

FOREIGN PATENT DOCUMENTS

JP 61-252190 A 11/1986
JP 7-290685 A 11/1995
(Continued)

OTHER PUBLICATIONS

International Search Report issued in corresponding International Patent Application No. PCT/JP2020/035207, dated Dec. 8, 2020.
(Continued)

*Primary Examiner* — Hoan H Tran
(74) *Attorney, Agent, or Firm* — Merchant & Gould P.C.

(57) ABSTRACT

In a foil transfer device for transferring a transfer layer from a foil film onto a sheet laid on the foil film, the foil film is wound on a supply reel, and taken up on a take-up reel. A heating member heats the foil film, and a pressure member is provided to press the foil film and the sheet between the pressure member and the heating member. A separator changes a traveling direction of the foil film having passed through between the heating member and the pressure member into a direction different from a direction of conveyance of the sheet, to thereby separate the foil film from the sheet. A first fan blows air toward the foil film positioned between the heating member and the separator.

29 Claims, 17 Drawing Sheets

(58) Field of Classification Search
USPC ..... 399/121, 231
See application file for complete search history.

(56) References Cited

U.S. PATENT DOCUMENTS

| | | | |
|---|---|---|---|
| 2015/0020702 | A1 | 1/2015 | Weber et al. |
| 2015/0063858 | A1 | 3/2015 | Nakamura et al. |
| 2021/0311426 | A1 | 10/2021 | Ichikawa et al. |

FOREIGN PATENT DOCUMENTS

| | | | |
|---|---|---|---|
| JP | 2001-1619 | A | 1/2001 |
| JP | 2005-74720 | A | 3/2005 |
| JP | 2008-532791 | A | 8/2008 |
| JP | 2012-141534 | A | 7/2012 |
| JP | 2013-121709 | A | 6/2013 |
| JP | 2013-190627 | A | 9/2013 |
| JP | 2015-20436 | A | 2/2015 |
| JP | 2020-121788 | A | 8/2020 |
| WO | 2020/136939 | A1 | 7/2020 |

OTHER PUBLICATIONS

International Preliminary Report on Patentability and Written Opinion of the International Searching Authority issued in corresponding International Patent Application No. PCT/JP2020/035207, dated Mar. 15, 2022.

* cited by examiner

FOIL TRANSFER DEVICE

CROSS-REFERENCE TO RELATED APPLICATION(S)

This application is a continuation of International Application No. PCT/JP2020/035207 filed on Sep. 17, 2020, which claims priority from Japanese Patent Application No. 2019-175554 filed on Sep. 26, 2019, and Japanese Patent Application No. 2020-012595 filed Jan. 29, 2020, the disclosures of all which are incorporated herein by reference in their entirety.

TECHNICAL FIELD

This disclosure relates to a foil transfer device for transferring foil onto a sheet.

BACKGROUND ART

A foil transfer device in which a foil film containing foil is laid on and heated with a sheet having a toner image formed thereon to transfer the foil onto the toner image is known in the art.

SUMMARY

In this foil transfer device, when a sheet and a foil film laid thereon are heated to high temperatures, the easy-to-release property of the foil film being about to be separated from a sheet would disadvantageously become degraded, so that the foil cannot be transferred as desired.

It would be desirable to improve the easy-to-release property of the foil film to be separated from a sheet.

In one aspect, a foil transfer device for transferring a foil-containing transfer layer from a foil film having the transfer layer, onto a sheet laid on the foil film is disclosed. The foil transfer device comprises a supply reel on which a foil film is wound and which is configured to supply the foil film, a take-up reel on which to take up the foil film, a heating member configured to heat the foil film, a pressure member configured to press the foil film and the sheet between the pressure member and the heating member, a separator configured to change a direction of travel of the foil film having passed through between the heating member and the pressure member, into a direction different from a direction of conveyance of the sheet, to thereby separate the foil film from the sheet, and a first fan configured to blow air toward the foil film positioned between the heating member and the separator.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

A description will be given of several embodiments of a foil transfer device with reference made to the drawings where appropriate.

Figure 1A:
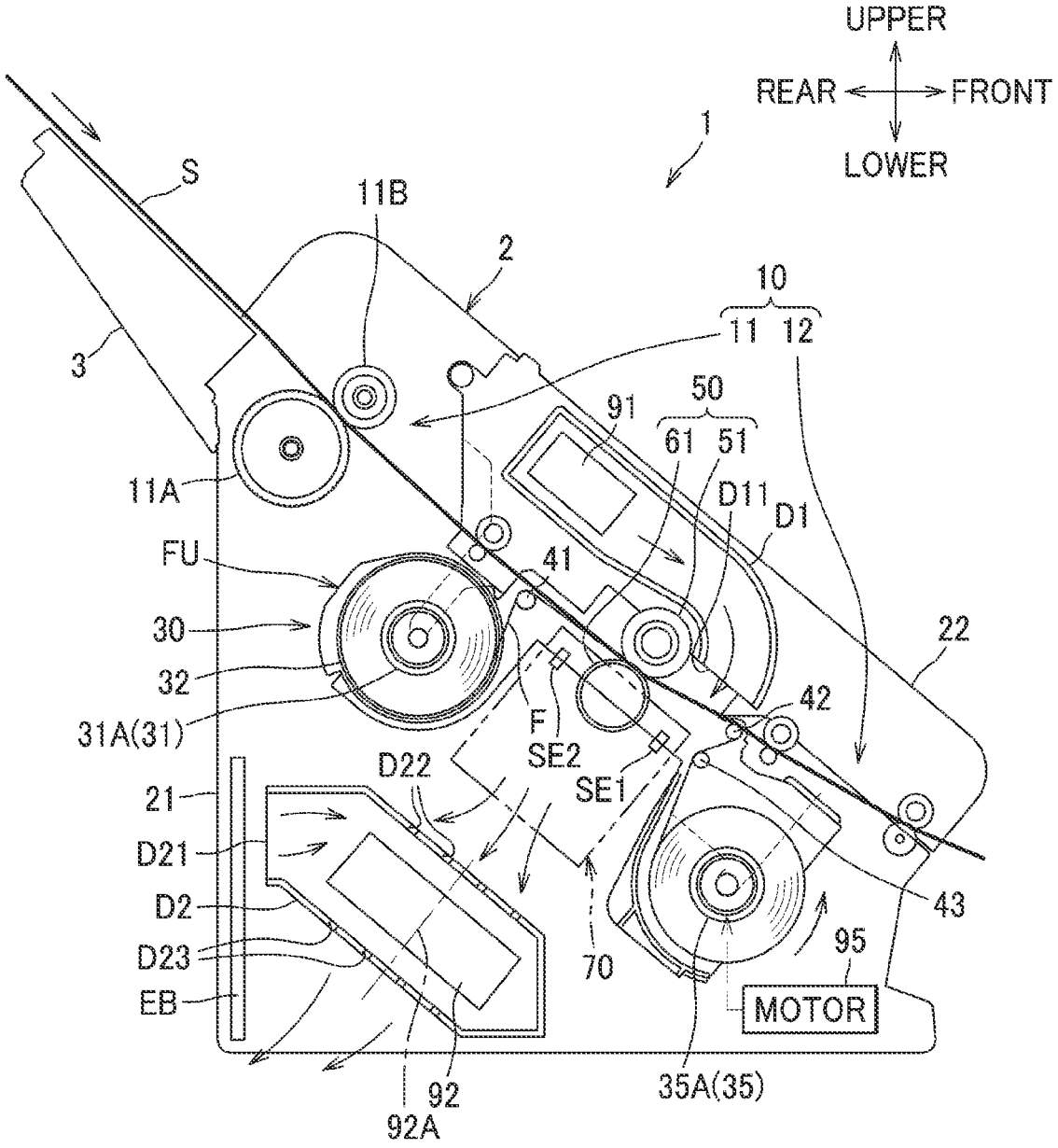
FIG. 1A is a diagram showing a foil transfer device according to a first embodiment.

In the following description, directions will be referred to as directions shown in FIG. 1A. That is, the right-hand side of FIG. 1A is referred to as "front", the left-hand side of FIG. 1A as "rear", the front side of the drawing sheet of FIG. 1A as "left", and the back side of the drawing sheet of FIG. 1A as "right". Similarly, upward/downward directions (upper/lower sides) of FIG. 1A are referred to as "upward/downward (upper/lower)".

First, a detailed description will be given of a first embodiment with reference made mainly to FIGS. 1 to 7. As shown in FIG. 1A, a foil transfer device 1 is a device for transferring a foil-containing transfer layer (a layer containing foil, such as of aluminum) onto a toner image formed on a sheet S by an image forming apparatus such as a laser printer. The foil transfer device 1 includes a housing 2, a sheet tray 3, a sheet conveyor unit 10, a film supply unit 30, and a transfer unit 50.

The housing 2 is made of plastic or the like, and includes a housing main body 21 and a cover 22. The housing main body 21 has an opening 21A at its upper side (see FIG. 2). The opening 21A is an opening through which to allow a film unit FU as will be described later to be installed into or removed from the housing main body 21. The opening 21A faces upward. The cover 22 is a member for opening and closing the opening 21A. A rear end portion of the cover 22 is rotatably supported by the housing main body 21.

The sheet tray 3 is a tray on which sheets S such as paper, OHP film, etc., are to be placed. The sheet tray 3 is provided at a rear portion of the housing 2. The sheets S of which surfaces having toner images formed thereon face downward are placed on the sheet tray 3.

The sheet conveyor unit 10 includes a sheet feed mechanism 11 and a sheet ejection mechanism 12. The sheet feed mechanism 11 is a mechanism that conveys sheets S on the sheet tray 3 one by one toward the transfer unit 50. The sheet feed mechanism 11 includes a pickup roller 11A and a retard roller 11B. The pickup roller 11A feeds a sheet S on the sheet tray 3 toward the transfer unit 50. The retard roller 11B is opposed to the pickup roller 11A. The retard roller 11B rotates in a direction opposite to a direction of feed of the sheets S to separate one sheet S from others.

The sheet ejection mechanism 12 is a mechanism that ejects a sheet S which has passed through the transfer unit 50, to the outside of the housing 2. The sheet ejection mechanism 12 includes a plurality of rollers.

The film supply unit 30 is a unit that supplies and lays a foil film F onto an underside of a sheet S conveyed from the sheet feed mechanism 11. The film supply unit 30 includes a film unit FU, and a motor 95, as an example of a driving source.

Figure 2:
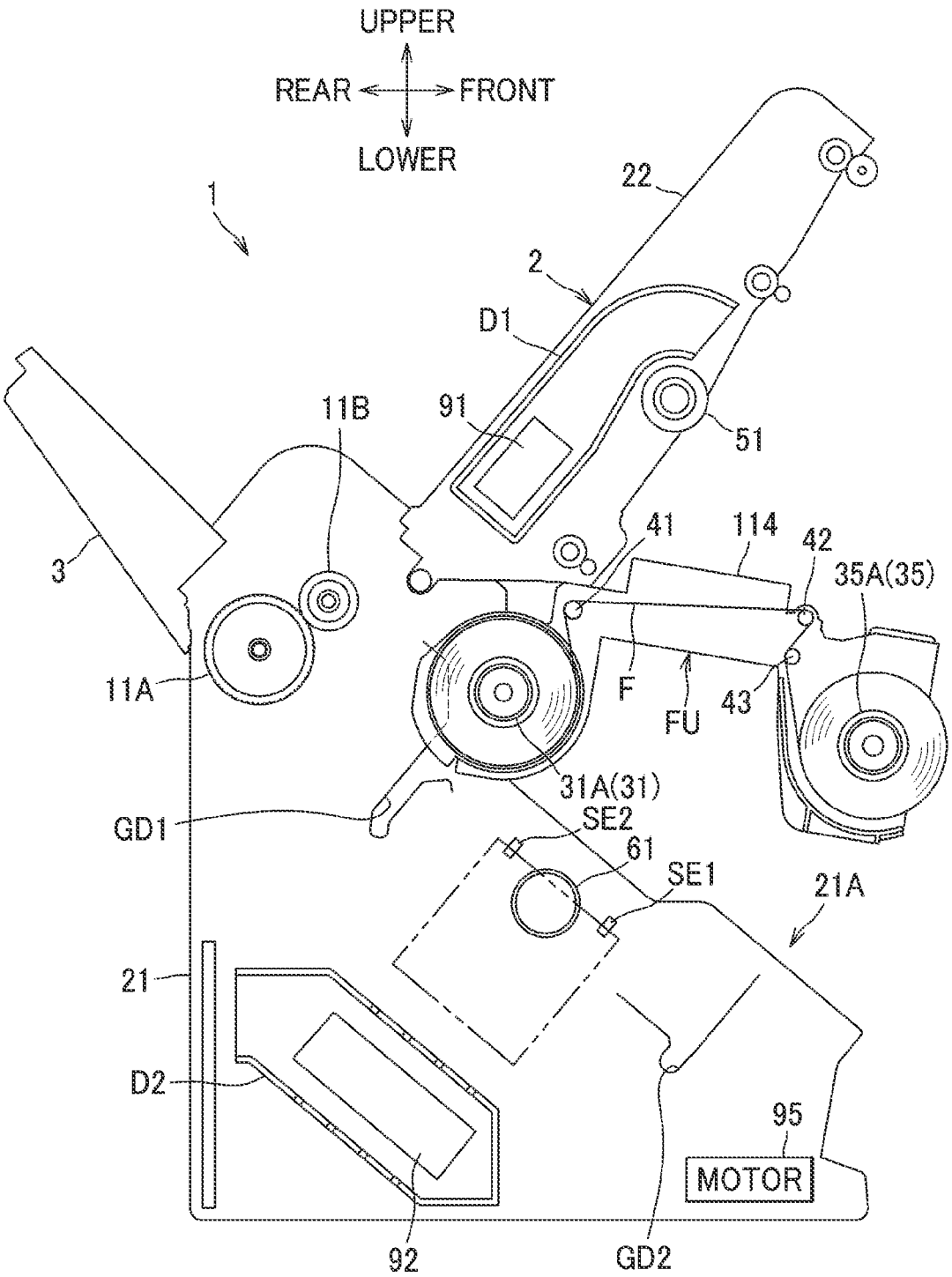
FIG. 2 is a diagram showing an open cover state of the foil transfer device.

The film unit FU is configured, as shown in FIG. 2, to be removably installable from above into the housing main body 21. The film unit FU includes a supply reel 31, a take-up reel 35, a first guide shaft 41, a second guide shaft 42 as a separator, and a third guide shaft 43. A foil film F is wound on the supply reel 31 of the film unit FU.

Figure 1B:
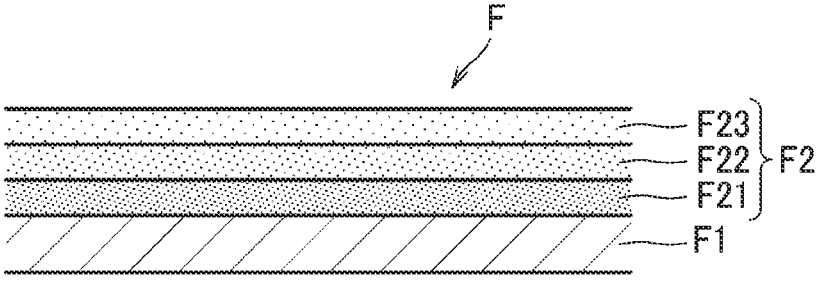
FIG. 1B is a section view showing a structure of a foil film.

As shown in FIG. 1B, the foil film F is a multilayer film made up of a plurality of layers. To be more specific, the foil film F includes a supporting layer F1 and a supported layer F2. The supporting layer F1 is a transparent substrate in the form of a tape and made of polymeric material, and supports the supported layer F2.

The supported layer F2 includes a release layer F21, a transfer layer F22, and an adhesive layer F23. The release layer F21 is a layer for facilitating separation of the transfer layer F22 from the supporting layer F1, and is interposed between the supporting layer F1 and the transfer layer F22. The release layer F21 contains a transparent material, such as a wax-type resin, easily releasable from the supporting layer F1.

The transfer layer F22 is a layer to be transferred onto a toner image, and contains foil. Foil is a thin sheet of metal such as gold, silver, copper, aluminum, etc. The transfer layer F22 contains a colorant of gold-colored, silver-colored, red-colored, or other colored material, and a thermoplastic resin. The transfer layer F22 is interposed between the release layer F21 and the adhesive layer F23.

The adhesive layer F23 is a layer for facilitating adhesion of the transfer layer F22 to a toner image. The adhesive layer F23 contains a material, such as vinyl chloride resin, acrylic resin, etc., which tends to adhere to a toner image heated by the transfer unit 50 which will be described later.

The supply reel 31 is made of plastic or the like, and includes a supply shaft 31A on which a foil film F is wound, as shown in FIG. 1A. One end of the foil film F is fixed to the supply shaft 31A. The foil film F is wound on the supply shaft 31A in such a manner that the supported layer F2 containing the transfer layer F22 is in contact with the supply shaft 31A. In other words, when the foil film F is wound on the supply shaft 31A, the supporting layer F1 faces outside and the supported layer F2 (transfer layer F22) faces inside. Accordingly, in an outermost portion of a roll of the foil film F wound on the supply shaft 31A, the supporting layer F1 is positioned outside of the supported layer F2.

The take-up reel 35 is made of plastic or the like, and includes a take-up shaft 35A on which to take up the foil film F. The other end of the foil film F is fixed to the take-up shaft 35A. The foil film F is to be wound on the take-up shaft 35A in such a manner that the supported layer F2 containing the transfer layer F22 comes in contact with the take-up shaft 35A. In other words, when the foil film F is wound on the take-up shaft 35A, the supporting layer F1 faces outside and the supported layer F2 (transfer layer F22) faces inside. Accordingly, in an outermost portion of a roll of the foil film F wound on the take-up shaft 35A, the supporting layer F1 is positioned outside of the supported layer F2.

It is to be understood that in FIG. 1A or other drawing figures, the supply reel 31 and the take-up reel 35 are illustrated for convenience's sake as if the both reels were wound up to the maximum. In actuality, the film unit FU in new condition has its foil film F wound on the supply reel 31 in a roll of a maximum diameter, while no foil film F is wound on the take-up reel 35, or the foil film F is wound on the take-up reel 35 but in a roll of a minimum diameter. When the film unit FU is at the end of its life (i.e., the foil film F has been exhausted), the foil film F is wound on the take-up reel 35 in a roll of a maximum diameter, while no foil film F is wound on the supply reel 31, or the foil film F is wound on the supply reel 31 but in a roll of a minimum diameter.

The first guide shaft 41, second guide shaft 42 and third guide shaft 43 are shafts for changing traveling directions of the foil film F. The first guide shaft 41, second guide shaft 42 and third guide shaft 43 are made of SUS (stainless steel) or the like. The first guide shaft 41, second guide shaft 42 and third guide shaft 43 may be made of SUS shafts covered with plastic covers.

The first guide shaft 41 is located upstream of the transfer unit 50 in a direction of conveyance of a sheet S. The first guide shaft 41 changes a traveling direction of the foil film F drawn out from the supply reel 31 into a direction approximately parallel to the direction of conveyance of the sheet S. The first guide shaft 41 is in contact with the supporting layer F1 of the foil film F. The first guide shaft 41 guides the foil film F drawn out from the supply reel 31 to cause the foil film F to be placed under a sheet S being conveyed with a toner image facing downward so that the sheet S is laid on the foil film F.

When the foil film F guided by this first guide shaft 41 is conveyed toward the transfer unit 50, the supported layer F2 thereof (see FIG. 1B) faces upward. When a sheet S is fed to the transfer unit 50, the sheet S is laid on the foil film F with the supported layer F2 facing upward, and the sheet S and the foil film F are conveyed toward the transfer unit 50.

The second guide shaft 42 is located downstream of the transfer unit 50 in the direction of conveyance of the sheet S. The second guide shaft 42 changes a traveling direction of the foil film F having passed through the transfer unit 50 (i.e., through between a pressure roller 51 and a heating roller 61, which will be described later in detail) into a direction different from the direction of conveyance of the sheet S to thereby separate the foil film F from the sheet S. The second guide shaft 42 is in contact with the supporting layer F1 of the foil film F.

The third guide shaft 43 is located between the second guide shaft 42 and the take-up reel 35. The third guide shaft 43 guides the foil film F separated from the sheet S, to the take-up reel 35. The third guide shaft 43 defines an angle at which the foil film F is separated from the sheet S (hereinafter referred to as "peel angle"). Herein, the peel angle is an angle formed by a portion of the foil film F stretched between the second guide shaft 42 and the third guide shaft 43 with respect to a portion of the foil film F stretched between the first guide shaft 41 and the second guide shaft 42. In other words, the peel angle is an angle formed by the traveling direction of the foil film F after separated from the sheet S with respect to the traveling direction of the foil film F passing through the transfer unit 50. The third guide shaft 43 changes a traveling direction of the foil film F guided by the second guide shaft 42 and guides the foil film F to the take-up reel 35. The third guide shaft 43 is in contact with the supported layer F2 (adhesive layer F23) of the foil film F.

In the film unit FU installed in the foil transfer device 1, the take-up reel 35 is caused to rotate in a counterclockwise direction as in FIG. 1 by the motor 95 provided in the housing 2. When the take-up reel 35 rotates, the foil film F wound on the supply reel 31 is drawn out, guided by the guide shafts 41, 42 and 43, and taken up on the take-up reel 35. To be more specific, during the foil transfer process, the foil film F is forwarded by the pressure roller 51 and the heating roller 61, which will be described later, whereby the foil film F is drawn out from the supply reel 31. The foil film F thus forwarded through between the pressure roller 51 and the heating roller 61 are taken up on the take-up reel 35.

The transfer unit 50 is a unit that heats and pressurizes the sheet S and the foil film F laid on each other, to transfer the transfer layer F22 onto a toner image formed on a sheet S. The transfer unit 50 includes a pressure roller 51 as an example of a pressure member, and a heating roller 61 as an example of a heating member. The transfer unit 50 applies heat and pressure to portions of a sheet S and a foil film F laid on each other and nipped between the pressure roller 51 and the heating roller 61.

The pressure roller 51 is a roller comprising a cylindrical metal core with its cylindrical surface coated with a rubber layer made of silicone rubber. The pressure roller 51 is located above the foil film F, and is contactable with a reverse side (opposite to a side on which a toner image is formed) of the sheet S.

The pressure roller 51 has two end portions supported rotatably by the cover 22. The pressure roller 51, which in combination with the heating roller 61, nips the sheet S and the foil film F, is driven to rotate by the motor 95 and causes the heating roller 61 to rotate accordingly.

The heating roller 61 is a roller comprising a cylindrical metal tube with a heater 62 located inside, to heat the foil film F and the sheet S. The heating roller 61 is located under the foil film F, and is in contact with the foil film F. The heating roller 61 extends across the width of the foil film F, in a direction (across-the-width direction) perpendicular to the traveling direction of the foil film F. The heater 62 generates heat to heat the heating roller 61.

The foil transfer device 1 includes a contact/separation mechanism 70 configured to cause either one or both of the heating roller 61 and the pressure roller 51 to move between a contact position in which the pressure roller 51 is pressed against the heating roller 61 and a separate position in which the heating roller 61 and the pressure roller 51 are located apart from each other. In the present embodiment, the contact/separation mechanism 70 is configured to cause the heating roller 61 to move between a contact position in which the heating roller 61 is in contact with the foil film F and a separate position in which the heating roller 61 is separate from the foil film F. The contact/separation mechanism 70 is located between the supply reel 31 and the take-up reel 35 along a path of conveyance of a sheet S. The contact/separation mechanism 70 is configured such that when the cover 22 is in a closed state, the heating roller 61 is moved to the contact position and brought into contact with the foil film F at each time when a sheet S is supplied to the transfer unit 50. Furthermore, the contact/separation mechanism 70 is configured such that when the cover 22 is open or when the process of transferring foil onto a sheet S is not executed in the transfer unit 50, the heating roller 61 is kept in the separate position separate from the foil film F.

In the foil transfer device 1 configured as described above, sheets S stacked on the sheet tray 3, with their front surfaces facing downward, are conveyed one by one toward the transfer unit 50 by the sheet feed mechanism 11. Each sheet S thus conveyed to a position upstream of the transfer unit 50 in a sheet conveyance direction is laid on the foil film F supplied from the supply reel 31, and further conveyed to the transfer unit 50 with a toner image of the sheet S being kept in contact with the foil film F.

In the transfer unit 50, the sheet S and the foil film F nipped and passing through between the pressure roller 51 and the heating roller 61 are heated and pressurized by the heating roller 61 and the pressure roller 51, so that foil (supported layer F2) is transferred onto the toner image.

After the foil has been transferred, the sheet S and the foil film F adhered to each other are conveyed to the second guide shaft 42. When the sheet S and the foil film F travels past the second guide shaft 42, the traveling direction of the foil film F is changed into a direction different from the direction of conveyance of the sheet S; thereby, the foil film F is peeled from the sheet S, that is, the supported layer F2 adhered to the toner image is separated from the supporting layer F1 of the foil film F.

The foil film F peeled from the sheet S and containing the supporting layer F1 separated from the supported layer F2 adhered to the toner image on the sheet S is taken up on the take-up reel 35. On the other hand, the sheet S on which the transfer layer F22 (foil) of the foil film F is transferred and which is separated from the supported layer F2 has a foil transferred surface facing downward and is ejected by the sheet ejection mechanism 12 to the outside of the housing 2.

Figure 3:
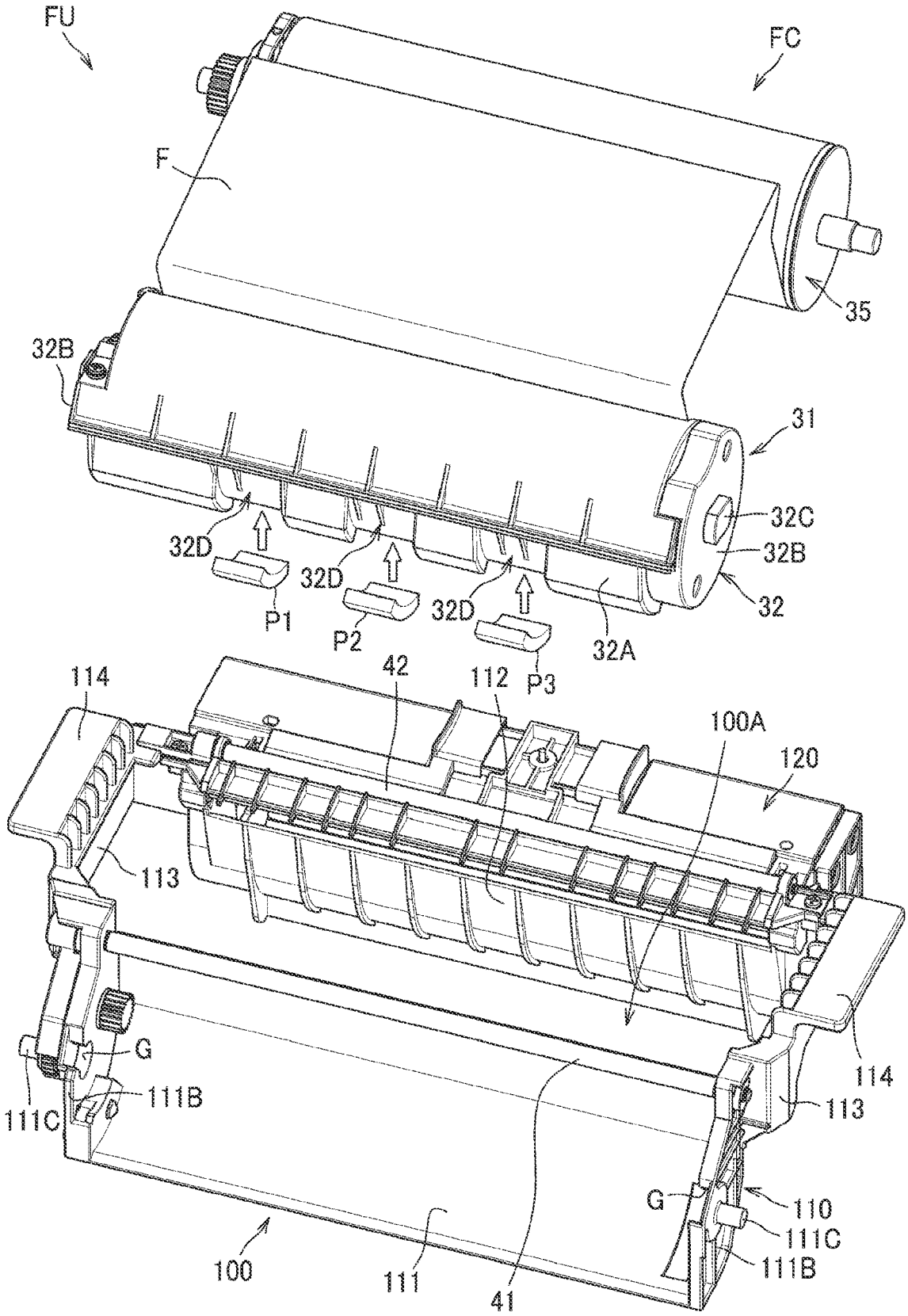
FIG. 3 is an exploded perspective view of a film unit as disassembled into a holder and a film cartridge.

As shown in FIG. 3 and FIG. 4, the film unit FU includes a holder 100 made of plastic or the like, and a film cartridge FC installable in and removable from the holder 100. The film cartridge FC includes a supply reel 31 and a take-up reel 35 as described above, and a supply case 32. The film cartridge FC installed in the holder 100 can be installed into and removed from the housing main body 21 through the opening 21A of the housing main body 21.

The supply reel 31 (more specifically, the supply case 32) and the take-up reel 35 are installable into and removable from the holder 100 in directions perpendicular to the axial direction of the supply reel 31.

The supply case 32 is a hollow case accommodating the supply reel 31. The supply case 32 is made of plastic or the like, and includes an outer peripheral wall 32A having an approximately cylindrical shape, and two side walls 32B each having an approximately discoidal shape. The side walls 32B are provided at both ends of the outer peripheral wall 32A. The supply reel 31 is rotatably supported by the side walls 32B of the supply case 32.

The outer peripheral wall 32A has formed therein three recesses 32D arranged in the axial direction of the supply reel 31; engageable pieces P1, P2 and P3 as identifiers can be fixed in the recesses 32D, respectively.

Each of the side walls 32B includes an engageable portion 32C having an elongate shape as viewed from outside in the axial direction of the supply reel 31. Each engageable portion 32C is a portion to be guided by installation/removal guides G of the holder 100, which will be described below. The engageable portion 32C has a rounded-corner rectangular shape (more precisely, an elongated shape having two straight parallel sides and two round ends) as viewed from outside in the axial direction of the supply reel 31.

The holder 100 includes a base frame 110 and a restraining frame 120 rotatably (movably) supported by the base frame 110.

The base frame 110 supports the first guide shaft 41 and the second guide shaft 42 in such a manner as to render the first guide shaft 41 and the second guide shaft 42 rotatable. The base frame 110 includes a first holding portion 111, a second holding portion 112, two connecting portions 113 and two handles 114.

The restraining frame 120 supports the third guide shaft 43 in such a manner as to render the third guide shaft 43 rotatable.

The first holding portion 111 is a portion that holds the supply case 32. The first holding portion 111 holds the supply reel 31 via the supply case 32.

The first holding portion 111 includes two side walls 111B.

Each of the side walls 111B has an installation/removal guide G for guiding the supply case 32 in predetermined directions when the supply case 32 is installed and removed.

At outer sides of the side walls 111B, bosses 111C are provided. Each boss 111C is a portion to be guided by a first guide GD1 formed in the housing main body 21 (see FIG. 2), when the film unit FU is installed into and removed from the housing main body 21.

The second holding portion 112 is a portion that holds the take-up reel 35. To be more specific, the second holding portion 112 is combined with the restraining frame 120 to make up a hollow case, and the take-up reel 35 is accommodated in the hollow case. The take-up shaft 35A of the take-up reel 35 protrudes outward in the axial direction of the take-up reel 35 from the second holding portion 112 and the restraining frame 120; protruded portions of take-up shaft 35A each serve as a portion to be guided by a second guide GD2 formed in the housing main body 21 (see FIG. 2), when the film unit FU is installed into and removed from the housing main body 21.

The two connecting portions 113 are portions that connect the first holding portion 111 and the second holding portion 112. The connecting portions 113 are arranged apart from each other in the axial direction of the supply reel 31.

With the connecting portions 113 being formed in this way, the holder 100 is provided with a through hole 100A extending in a perpendicular direction perpendicular to the axial direction of the supply reel 31. With this configuration, the heating roller 61 caused to move by the contact/separation mechanism 70 described above is allowed to pass through the through hole 100A, so that the heating roller 61 can be brought into contact with, and separated from, the foil film F.

The handle 114 is provided on each of the connecting portions 113. The handles 114 are located at opposite ends of the holder 100 corresponding to the ends of the take-up reel 35 apart from each other in the axial direction of the take-up reel 35.

Different kinds of film cartridges FC with foil films having different widths and positions can selectively be installed in the holder 100 for use in the foil transfer device 1. For example, a first film cartridge FC1, a second film cartridge FC2, or a third film cartridge FC3 as shown in FIGS. 4A, 4B and 4C can be installed in the holder 100.

Figure 4A:
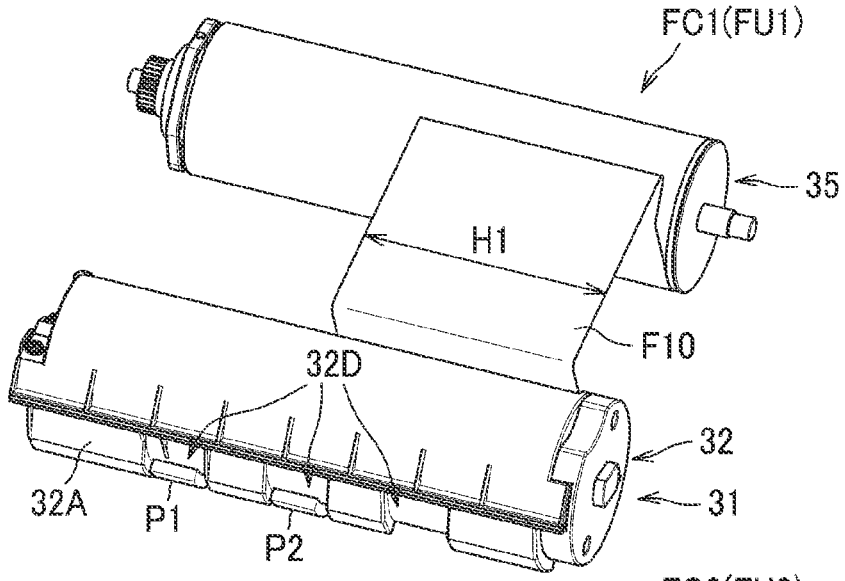
FIGS. 4A to 4C are perspective views of three kinds of film cartridges with foil films having different widths and positions.

A film unit FU in which the first film cartridge FC1 with a first foil film F10 having a width H1 and located in a position shifted to one side in an across-the-width direction of the first foil film F10 as shown in FIG. 4A is installed is herein referred to as a first film unit FU1. The first film unit FU1 holds the first foil film F10 in such a manner that when the first film unit FU1 is installed in the foil transfer device 1, the first foil film F10 is located in a position shifted from the center of the heating roller 61 to a position closer to one end than to the other end of the heating roller 61. The width H1 is a width smaller than a width of a sheet S having a maximum width, of sheets S usable in the foil transfer device 1, for example, 110 mm (half a width H3 which will be described below).

In the first film unit FU1, the engageable pieces P1, P2 are fixed in two of the three recesses 32D formed in the outer peripheral wall 32A, i.e., the center recess 32D and either one of the left or right recess 32D, while no engageable piece is fixed in the other of the left or right recess 32D.

Figure 4B:
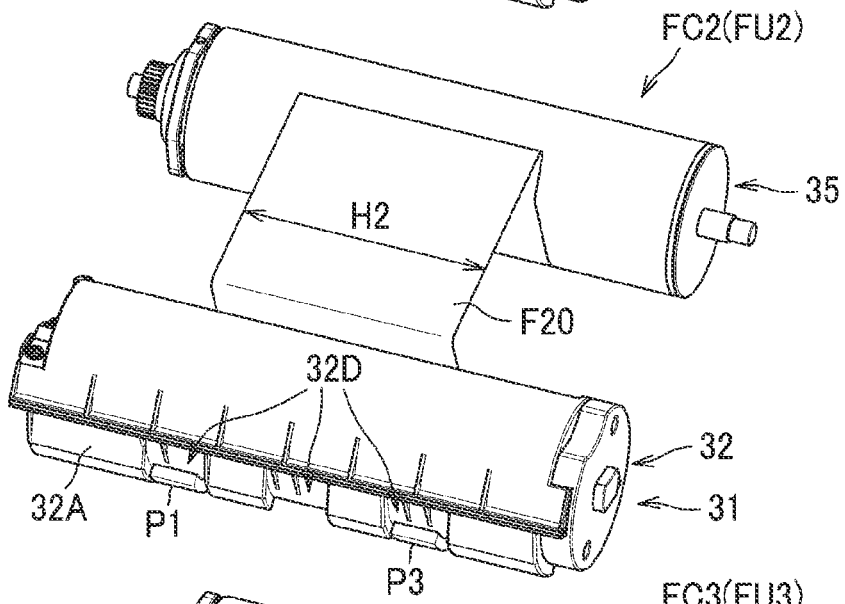
Figure 4C:
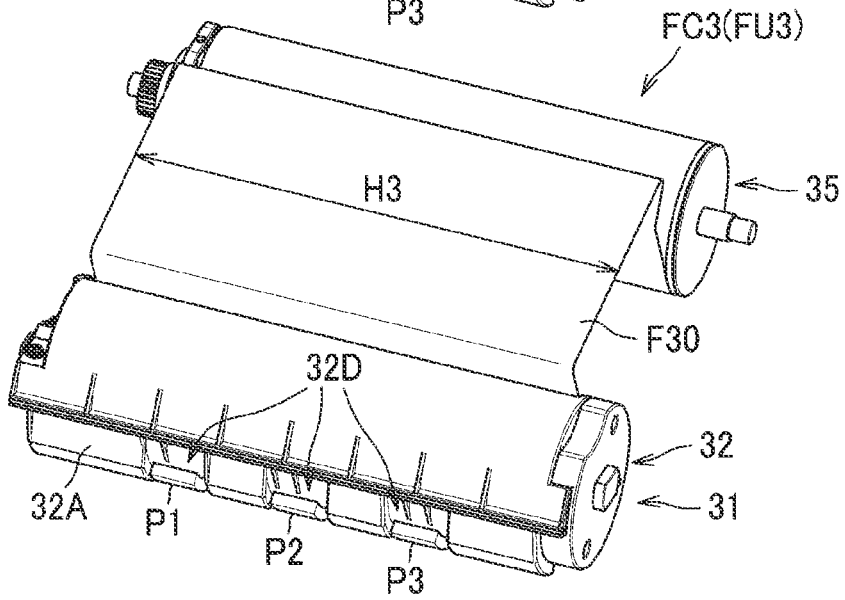

A film unit FU in which the second film cartridge FC2 with a second foil film F20 having a width H2 and located in a position shifted to the center in the across-the-width direction of the second foil film F20 as shown in FIG. 4B is installed is herein referred to as a second film unit FU2. The second film unit FU2 holds the second foil film F20 in such a manner that when the second film unit FU2 is installed in the foil transfer device 1, the second foil film F20 is located in a central position in an axial direction of the heating roller 61. The width H2 is a width smaller than the width of a sheet S having the maximum width, of sheets S usable in the foil transfer device 1, for example, 110 mm (half the width H3 which will be described below).

In the second film unit FU2, the engageable pieces P1, P3 are fixed in two of the three recesses 32D formed in the outer peripheral wall 32A, i.e., the left and right recesses 32D, while no engageable piece is fixed in the center recess 32D.

A film unit FU in which the third film cartridge FC3 with a third foil film F30 having a width H3 as shown in FIG. 4C is installed is herein referred to as a third film unit FU3. The third film unit FU3 holds the third foil film F30 in such a manner that when the third film unit FU3 is installed in the foil transfer device 1, the third foil film F20 is so located as to cover the heating roller 61 from one end to the other of the heating roller 61. The width H3 is a width greater than the width of a sheet S having the maximum width, of sheets S usable in the foil transfer device 1, for example, 220 mm.

In the third film unit FU3, the engageable pieces P1, P2 and P3 are fixed in all the three recesses 32D formed in the outer peripheral wall 32A.

The housing main body 21 is configured to allow each of the film units FU1, FU2 and FU3 to be selectively installed therein. The foil transfer device 1 includes three sensors corresponding to the engageable pieces P1, P2 and P3 so that the kind of the film unit FU installed can be identified by a combination of signals outputted from the three sensors.

Figure 5:
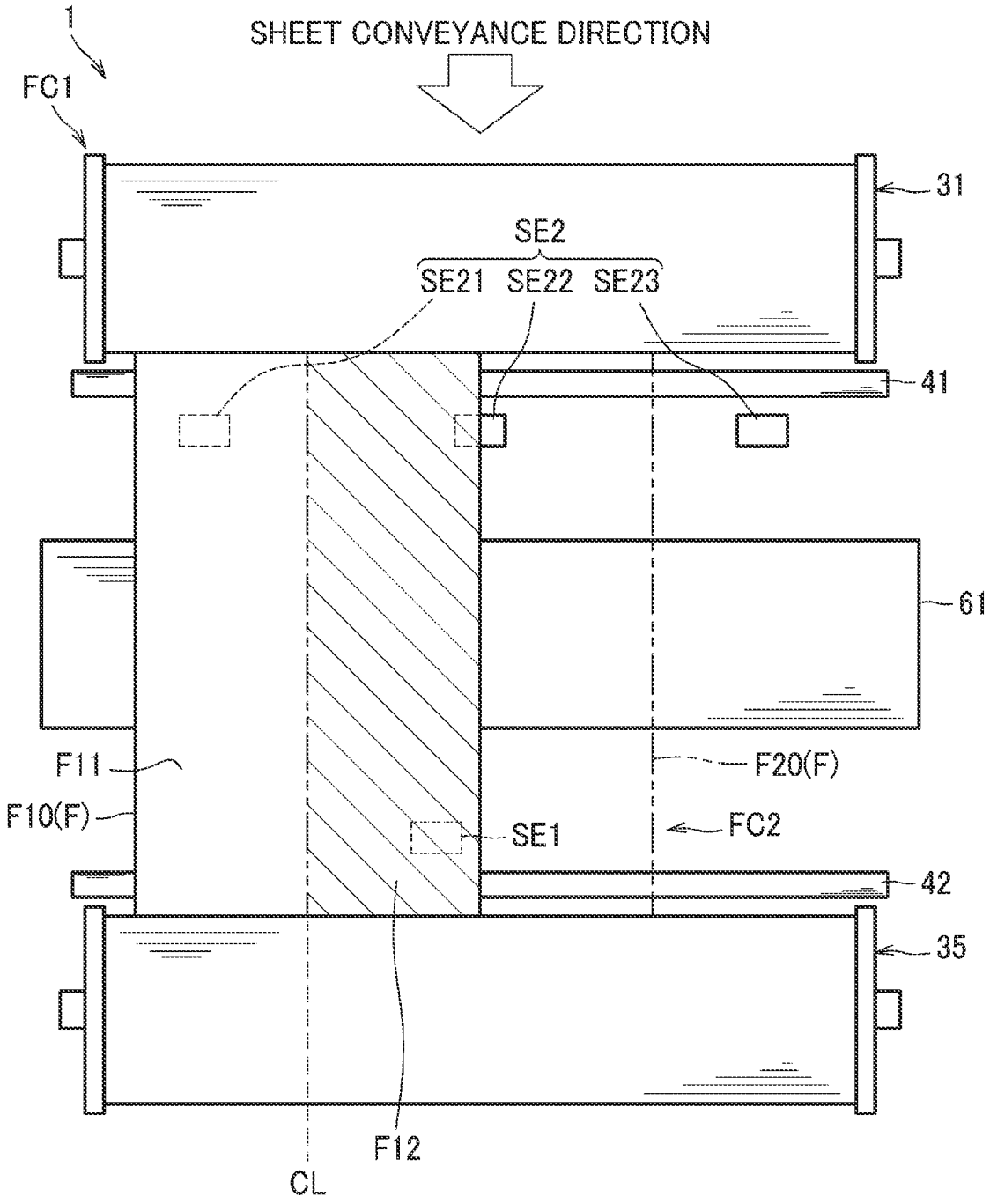
FIG. 5 is a diagram showing positions of the temperature detectors relative to the foil films.

As shown in FIG. 1A and FIG. 5, the foil transfer device 1 includes a first temperature detector SE1 and a second temperature detector SE2 both of which are capable of detecting temperatures of the heating roller 61.

The first temperature detector SE1 is a thermostat configured to stop the supply of electricity to the heating roller 61 if the temperature of the heating roller 61 reaches or exceeds a predetermined value. The first temperature detector SE1 is located downstream of the heating roller 61 and the pressure roller 51 in the direction of conveyance of a sheet S. The first temperature detector SE1 is located in a position behind the foil film F such that the foil film F overlaps the first temperature detector SE1 when an upper side of the foil film F positioned between the heating roller 61 and the second guide shaft 42 on which a sheet S is to be laid is viewed straight on in a direction perpendicular thereto (see FIG. 1A).

In other words, the first temperature detector SE1 is located in a position under part of the foil film F positioned between the heating roller 61 and the second guide shaft 42 such that a projection of the first temperature detector SE1 in a normal direction (i.e., a direction pointed, perpendicular to a surface of that part of the foil film F, toward that part of the foil film F) falls within that part of the foil film F.

The position of the first foil film F10 of the first film cartridge FC1 installed in the housing main body 21 in an across-the-width direction of the first foil film F10 is different from the position of the second foil film F20 of the second film cartridge FC2 installed in the housing main body 21 in an across-the-width direction of the second foil film F20. To be more specific, the first foil film F10 consists of a first half F11 and a second half F12. The first half F11 is a portion located on one side in the across-the-width direction of the first foil film F10 with respect to a center CL (predetermined position) in the across-the-width direction of the first foil film F10. The second half F12 is a portion located on the other side in the across-the-width direction of the first foil film F10. The first half F11 of the first foil film F10 is a portion located outside a region (indicated in chain double-dashed lines in FIG. 5) to be occupied by the second foil film F20 when the second film cartridge FC2 is installed in the housing main body 21, in the across-the-width direction. The second half F12 of the first foil film F10 is a portion (indicated by hatch lines in FIG. 5) located within the region to be occupied by the second foil film F20 when the second film cartridge FC2 is installed in the housing main body 21, in the across-the-width direction.

The first temperature detector SE1 is located in such a position that the second half F12 of the first foil film F10 overlaps the first temperature detector SE1 when the first film cartridge FC1 is installed in the housing main body 21 and an upper side of the first foil film F10 positioned between the heating roller 61 and the second guide shaft 42 is viewed straight on in the normal direction (i.e., a direction perpendicular to the upper surface). Accordingly, the position in which the first temperature detector SE1 is located is such that the first foil film F10 overlaps the first temperature detector SE1 when the first film cartridge FC1 is installed in the housing main body 21 and the upper side of the first foil film F10 positioned between the heating roller 61 and the second guide shaft 42 is viewed straight on in the direction perpendicular thereto, and that the second foil film F20 overlaps the first temperature detector SE1 when the second film cartridge FC2 is installed in the housing main body 21 and an upper side of the second foil film F20 positioned between the heating roller 61 and the second guide shaft 42 is viewed straight on in a direction perpendicular thereto. It is to be understood, although not illustrated in the drawings, that the above-described position in which the first temperature detector SE1 is located is further characterized in that the third foil film F30 overlaps the first temperature detector SE1 when the third film cartridge FC3 is installed in the housing main body 21 and an upper side of the third foil film F30 positioned between the heating roller 61 and the second guide shaft 42 is viewed straight on in a direction perpendicular thereto.

The second temperature detector SE2 includes a first thermistor SE21, a second thermistor SE22, and a third thermistor SE23, which are capable of detecting a temperature for use in regulating an electric current to be passed through the heating roller 61. The first thermistor SE21, the second thermistor SE22, and the third thermistor SE23 are located upstream of the heating roller 61 and the pressure roller 51 in the direction of conveyance of a sheet S.

The first thermistor SE21 is located in a first position in the across-the-width direction of the foil film F. The second thermistor SE22 is located in a second position in the across-the-width direction of the foil film F. The second position is different from the first position in the across-the-width direction of the foil film F. The third thermistor SE23 is located in a third position in the across-the-width direction of the foil film F. The third position is different from the first position and from the second position in the across-the-width direction of the foil film F.

To be more specific, the first thermistor SE21 is located on a first side (that is one side with respect to a center of the heating roller 61 in the axial direction, i.e., at a position closer to one end than to the other end of the heating roller 61 in the axial direction) of the heating roller 61. The second thermistor SE22 is located at a position corresponding to the center of the heating roller 61 in the axial direction. The third thermistor SE23 is located on a second side (that is the other side with respect to the center of the heating roller 61 in the axial direction, i.e., at a position closer to the other end than to the one end of the heating roller 61 in the axial direction).

As shown in FIG. 1A, the foil transfer device 1 further includes a first fan 91, a first duct D1, a power supply board EB, a second fan 92, and a second duct D2. To be more specific, the cover 22 includes the first fan 91 and the first duct D1. The housing main body 21 includes the power supply board EB, the second fan 92, and the second duct D2.

The first fan 91 is a sirocco fan. The first fan 91 is a fan configured to blow air toward the foil film F positioned between the heating roller 61 and the second guide shaft 42. The first fan 91 is located upstream of the heating roller 61 in the direction of conveyance of a sheet S.

The first fan 91 is located above the foil film F. The first fan 91 is located within the first duct D1.

The first duct D1 is located above the foil film F. The first duct D1 is a duct through which to guide air forced out from the first fan 91, toward a surface (a surface facing upward; an upper side on which a sheet S is to be laid) of the foil film F positioned between the heating roller 61 and the second guide shaft 42. Accordingly, the first fan 91 is configured to be capable of blowing air toward a surface of the foil film F for a sheet S to be laid thereon. The first duct D1 extends from the first fan 91 downstream in the direction of conveyance of a sheet S. The first duct D1 is located above the pressure roller 51.

The first duct D1 has an air outlet D11 at a downstream end portion thereof located downstream in the direction of conveyance of a sheet S. The air outlet D11 is located in such a position, on an upper side of the path of conveyance of a sheet S, as to correspond to a position between the heating roller 61 and the second guide shaft 42 arranged along the path (on an underside of the path) of conveyance of a sheet S. The air outlet D11 faces the upper side of the foil film F positioned between the heating roller 61 and the second guide shaft 42.

Figure 6:
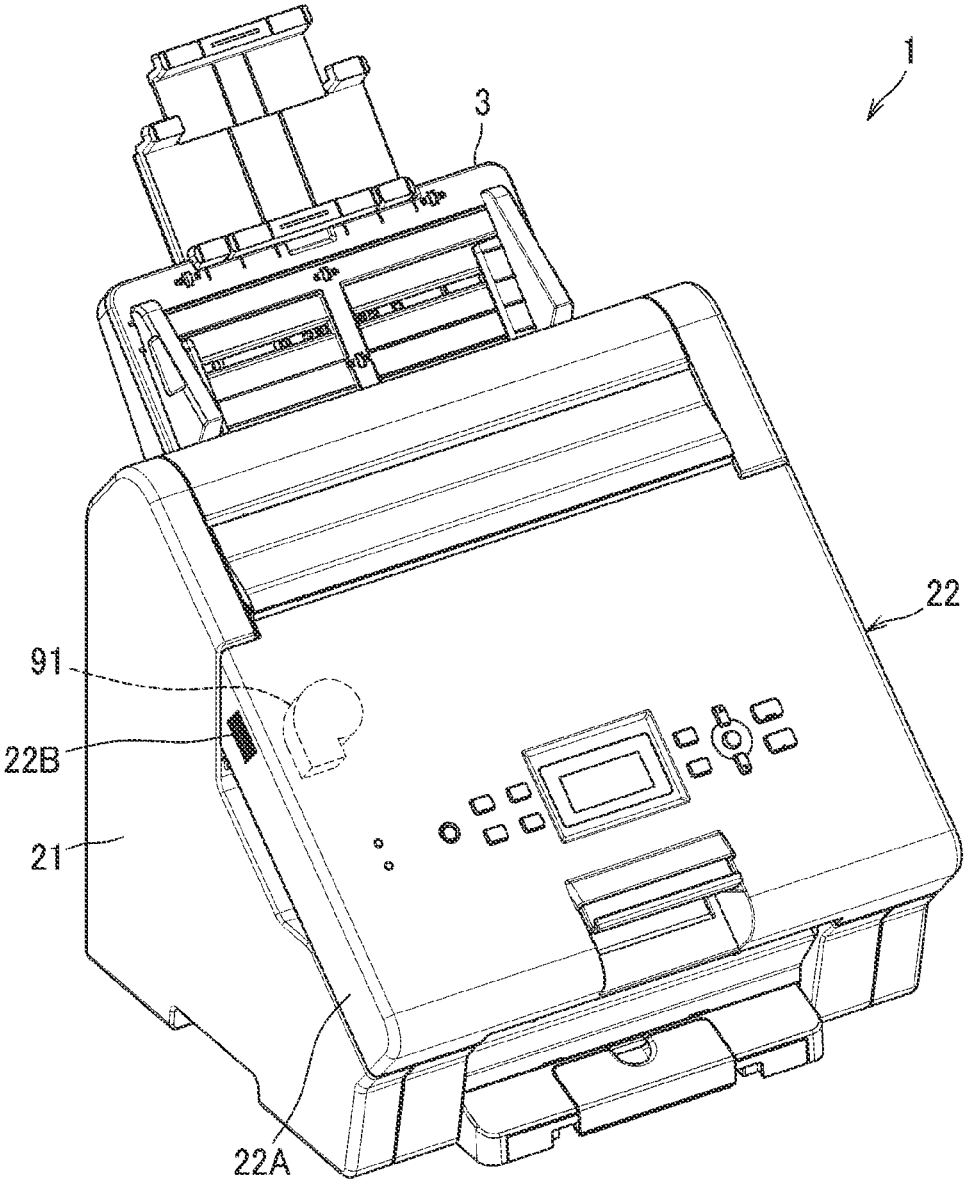
FIG. 6 is a perspective view showing the foil transfer device.

As shown in FIG. 6, the cover 22 has an air intake 22B at a side surface 22A thereof. The air intake 22B is made up of a plurality of slits, for example. The first fan 91 forces air taken in through the air intake 22B, to flow through the first duct D1 (see FIG. 1A) and blow from the cover 22 to the housing main body 21.

Figure 7:
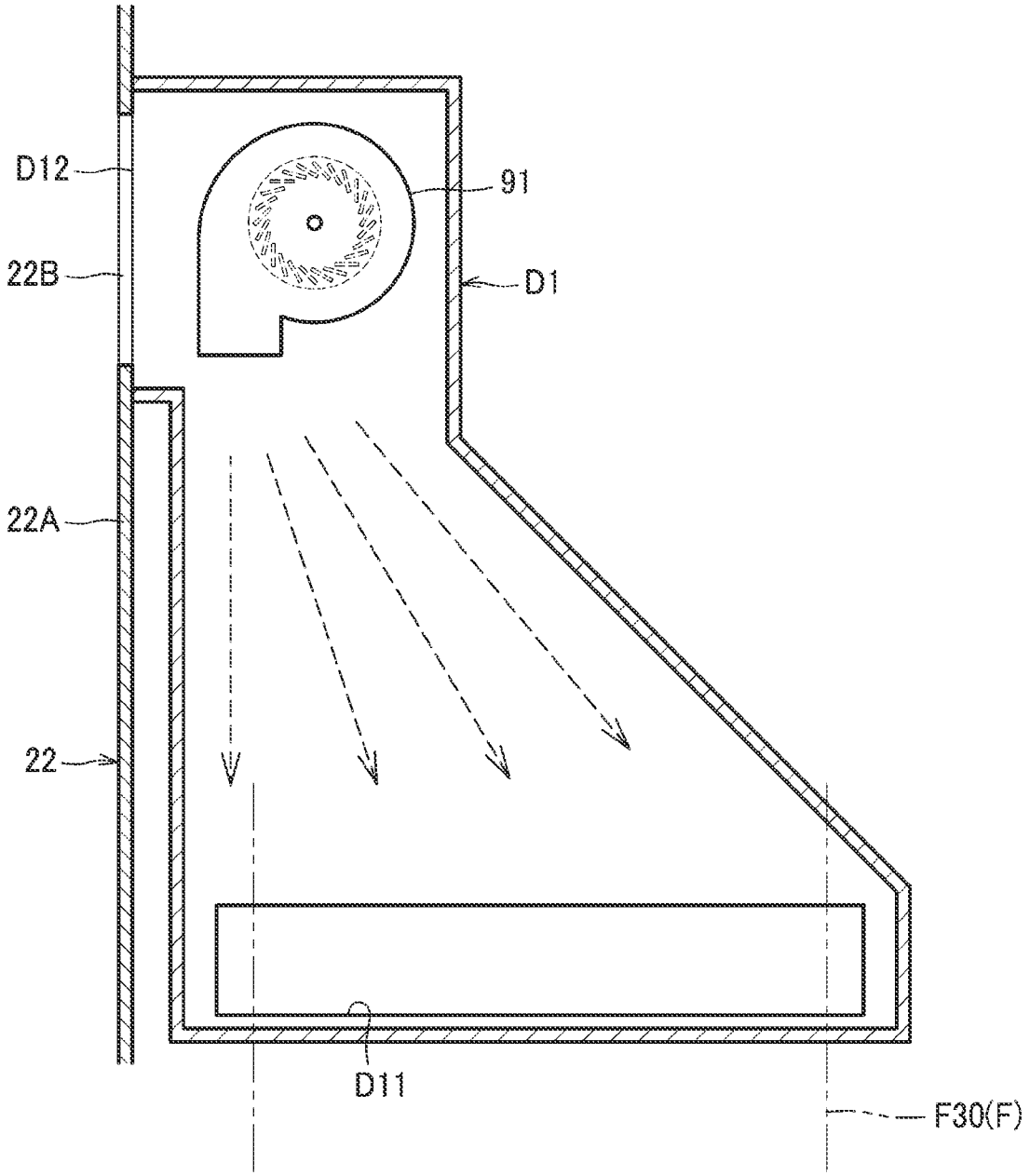
FIG. 7 is a section view showing a first duct.

As shown in FIG. 7, the first duct D1 has an air intake D12 that opens on the air intake 22B of the cover 22. The air intake D12 is located between the side surface 22A of the cover 22 and the first fan 91. The aforementioned air outlet D11 formed in the first duct D1 extends across the width of the foil film F, specifically, across the width of the third foil film F30 (i.e., from one side to the other throughout its width). In other words, the air outlet D11 is formed from one side to the other across the width of the widest foil film F (third foil film F30) of the group consisting of foil films F usable in the foil transfer device 1. Cross-sectional area of the duct D1 increases gradually with distance from the air intake D12 toward the air outlet D11.

The power supply board EB is a substrate on which electronic components for supplying electric power to a heater 62 in the heating roller 61, the motor 95, etc. are mounted. As shown in FIG. 1A, the power supply board EB is located in a lower and rearward position relative to the supply reel 31.

The second fan 92 is an axial fan. The second fan 92 is a fan configured to force out air around the foil film F positioned between the heating roller 61 and the second guide shaft 42. In other words, the second fan 92 is configured to force out air that has been caused to blow by the first fan 91 toward the foil film F positioned between the heating roller 61 and the second guide shaft 42.

The second fan 92 is located below the supply reel 31 and the contact/separation mechanism 70. The second fan 92 is located in such a position, on the underside of the path of conveyance of a sheet S (farther than the contact/separation mechanism 70 from the path of conveyance of a sheet S), as to correspond to a position between the supply shaft 31A of the supply reel 31 and the take-up shaft 35A of the take-up reel 35 arranged along the path (on the same underside of the path) of conveyance of a sheet S.

The second fan 92 as the axial fan has an axis 92A of rotation, along which the direction of air flow is confined. The axis 92A of the second fan 92 is directed toward a position between the supply reel 31 and the take-up reel 35. The second fan 92 is located within the second duct D2. It is to be understood that the axis 92A may preferably be directed toward a position between the heating roller 61 and the second guide shaft 42.

The second duct D2 is a duct through which to guide air around the power supply board EB to the second fan 92. The second duct D2 includes a first air intake hole D21, a plurality of second air intake holes D22, and a plurality of air outlet holes D23.

The first air intake hole D21 is located between the power supply board EB and the second fan 92. The first air intake hole D21 opens toward the power supply board EB.

Each of the second air intake holes D22 is located between the contact/separation mechanism 70 and the second fan 92 along the axial direction of the second fan 92. Each of the second air intake holes D22 opens on a region between the supply reel 31 and the take-up reel 35.

Each of the third air outlet holes D23 is located between the second fan 92 and an undersurface (bottom wall) of the housing main body 21 Each of the third air outlet holes D23 opens on the bottom wall of the housing main body 21. The undersurface of the housing main body 21 has a plurality of holes or openings. Accordingly, air forced out through the third air outlet holes D23 is discharged below to the outside of the housing main body 21.

As illustrated in FIG. 1A, when the foil transfer device 1 is operated to execute a foil transfer process, the first fan 91 and the second fan 92 are activated. The first fan 91 causes air outside the housing 2 to be taken through the air intake 22B of the cover 22 into the first duct D1, and to blow through the air outlet D11 of the first duct D1 toward the foil film F positioned between the heating roller 61 and the second guide shaft 42.

Accordingly, when the foil film F is separated from a sheet S at the second guide shaft 42, the foil film F and the sheet S (with the transfer layer F22 transferred on the sheet S) are cooled with air taken in from outside, whereby the easy-to-release property can be improved. An air current that has been blown on the foil film F and the sheet S from above passes through clearances at the side edges of the foil film F and the sheet S, and flows further downward.

In this way, the air current produced by the first fan 91 flows downward through clearances at the sides of the first temperature detector SE1 located under the foil film F positioned between the heating roller 61 and the second guide shaft 42. Therefore, the first temperature detector SE1 can detect the temperature of the heating roller 61 precisely without being adversely affected by the air current.

It is to be understood that the air current blowing against the sheet S or the foil film F positioned between the heating roller 61 and the second guide shaft 42 would possibly tend to move toward the second temperature detector SE2, but should get blocked by the heating roller 61 and the pressure roller 51. Therefore, the second temperature detector SE2 can be prevented from suffering from the effects of the air current.

The air (current) which has cooled the foil film F and the sheet S is caused to pass through clearances between the supply reel 31 and the take-up reel 35 (to be more specific, the clearance between the contact/separation mechanism 70 and the take-up reel 35, and/or the clearance between the contact/separation mechanism 70 and the housing main body 21, and the like), and drawn into the second duct D2, by the suction of the second fan 92. On the other hand, air around the power supply board EB is also drawn into the second duct D2. Air drawn into the second duct D2 is let out through the air outlet holes D23 of the second duct D2, the holes in the undersurface of the housing main body 21, and the like, to the outside of the housing 2.

In the embodiment as described above, the following advantageous effects can be achieved.

Since the foil film F and the sheet S positioned between the heating roller 61 and the second guide shaft 42 are cooled by air produced by the first fan 91, the easy-to-release property of the foil film F from the sheet S can be improved.

Since the first fan 91 blows air toward a surface (upper side) of the foil film F for a sheet S to be laid thereon, the need for making a space for the first fan 91 or a duct to implement the air-blowing function, between the supply reel 31 and the take-up reel 35 can be obviated. Accordingly, space between the supply reel 31 and the take-up reel 35 can be minimized to the extent necessary and practical, with the result that upsizing of the film unit FU can be restrained.

Since the opening 21A of the housing main body 21 faces upward, the film unit FU can be installed from above into the housing main body 21 and removed upward from the housing main body 21. It is to be understood that, for example, in an alternative configuration which requires a film unit to be installed in and removed from the housing main body in horizontal directions, a user should withstand the pull of gravity to keep the film unit in horizontal position when handling the film unit for installation or removal. In contrast, the above-described configuration which allows the film unit FU to be installed from above into the housing main body 21 and removed upward from the housing main body 21 does not require a user to withstand the pull of gravity to keep the film unit FU in horizontal position; therefore, the installation and removal can be done without difficulty. Furthermore, in the configuration which requires a film unit to be installed in and removed from the housing main body in horizontal directions, the film unit when installed or removed tends to sway from a specified (desired) position to an inclined position by the pull of gravity; therefore, the film unit is likely to interfere with members in the housing main body. In contrast, the above-described configuration which allows the film unit FU to be installed from above into the housing main body 21 and removed upward from the housing main body 21 makes the film unit FU unlikely to sway from a specified position to an inclined position, and thus can restrain the film unit FU from interfering from the members in the housing main body 21.

Since the cover 22 includes the first fan 91, the housing main body 21 can be downsized in comparison, for example, with an alternative configuration in which the housing main body includes a first fan.

Since the air intake 22B is provided in the side surface 22A of the cover 22, any liquid which would adhere to the upper surface of the cover 22 can be restrained form flowing into the housing main body 21, in comparison, for example, with an alternative configuration in which the air intake is provided in the upper surface of the cover.

Since the first fan 91 is located upstream of the heating roller 61 in the direction of conveyance of a sheet S, the first fan 91 is located at the back of the housing 2 of the typical foil transfer device 1 (of which the ejection port for a sheet S faces toward the front, i.e., user's side), and is thus remote from the user; therefore, the source of noise can be located away from the user whose discomfort from the noise can thus be alleviated.

Since the air outlet D11 formed in the first duct D1 extends across the width of the foil film F (from one end to the other throughout its width), air can be caused to blow on the overall widths of the foil film F and the sheet S; therefore, the foil film F and the sheet S can be cooled efficiently.

Since the second fan 92 configured to force out air around the foil film F positioned between the heating roller 61 and the second guide shaft 42 is provided, the foil film F and the sheet S positioned between the heating roller 61 and the second guide shaft 42 can be cooled efficiently.

Since the first fan 91 is a sirocco fan, air sucked in from a side thereof facing in the axial direction can be forced out in a radial direction; therefore, air taken into the first duct D1 through the air intake 22B formed in the side surface 22A of the cover 22 can be effectively forced out in the downstream direction of conveyance of a sheet S.

Since the second fan 92 is an axial fan, the quantity of air can be made greater, in comparison, for example, with an alternative configuration in which the second fan is a sirocco fan; therefore, the foil film F and a sheet S can be cooled more efficiently.

Since the second duct D2 through which to guide air around the power supply board EB to the second fan 92 is provided, the power supply board EB can be cooled down.

Since the first temperature detector SE1 is located in a position behind the foil film F such that the foil film F overlaps the first temperature detector SE1 when the upper side of the foil film F positioned between the heating roller 61 and the second guide shaft 42 on which the sheet S is to be laid is viewed straight on in a direction perpendicular thereto, the adverse effect of air from the first fan 91 on the first temperature detector SE1 can be reduced.

It is understood that space between the heating roller 61 and the second guide shaft 42 is subjected to the influence of heat derived from the foil F and the sheet S heated by the heating roller 61, and is thus likely to become hotter than the space upstream of the heating roller 61. Since the thermostat (first temperature detector SE1) is provided in such a location of which the temperature is likely to go up, the thermostat can be activated quickly without delay.

Since the foil film F of the film cartridge FC of any kind installed in the housing main body 21 overlaps the first temperature detector SE1 when an upper side of the foil film F positioned between the heating roller 61 and the second guide shaft 42 is viewed straight on in a direction perpendicular thereto, the adverse effect of air from the first fan 91 on the first temperature detector SE1 can be reduced irrespective of the kind of the film cartridge FC.

Since each of the thermistors SE21, SE22, SE23 is located upstream of the heating roller 61 and the pressure roller 51, the air current blowing against the sheet S or the foil film F positioned between the heating roller 61 and the second guide shaft 42, which would otherwise tend to move toward the thermistors SE21, SE22, SE23, should get blocked by the heating roller 61 and the pressure roller 51; therefore, the thermistors SE21, SE22, SE23 can be prevented from suffering from the adverse effects of the air current.

Since the thermistors SE21, SE22, SE23 are located in positions different from each other in the across-the-width direction, different portions of the heating roller 61 arranged in the across-the-width direction can be detected by the thermistors SE21, SE22, SE23.

It is to be understood that the present embodiment can be modified into various other forms as described below, for practical application.

In the above-described embodiment, the first fan 91 is configured to blow air toward the surface of the foil film F for a sheet S to be laid thereon; however, the first fan 91 may alternatively be configured to blow air toward the surface of the foil film F on the reverse side of the surface for a sheet S to be laid thereon, or in a direction across the width of the foil film.

In the above-described embodiment, the first fan 91 is provided in the cover 22, and the second fan 92 is provided in the housing main body 21; however, the first fan and the second fan may be located in any positions within the housing.

In the above-described embodiment, the first fan 91 is a sirocco fan, and the second fan 92 is an axial fan; however, the first fan and the second fan may be any type of fan.

In the above-described embodiment, the first duct D1 and the second duct D2 are provided; however, the duct(s) may not necessarily be provided.

In the above-described embodiment, the first temperature detector SE1 is a thermostat, and the second temperature detector SE2 is a thermistor; however, for example, the first temperature detector may be a thermistor, and/or the second temperature detector may be a thermostat.

A detailed description will be given of a second embodiment with reference made mainly to FIGS. 8 to 15. In the following description, elements having substantially the same configurations are designated by the same reference characters, and a duplicate description thereof will be omitted.

Figure 8:
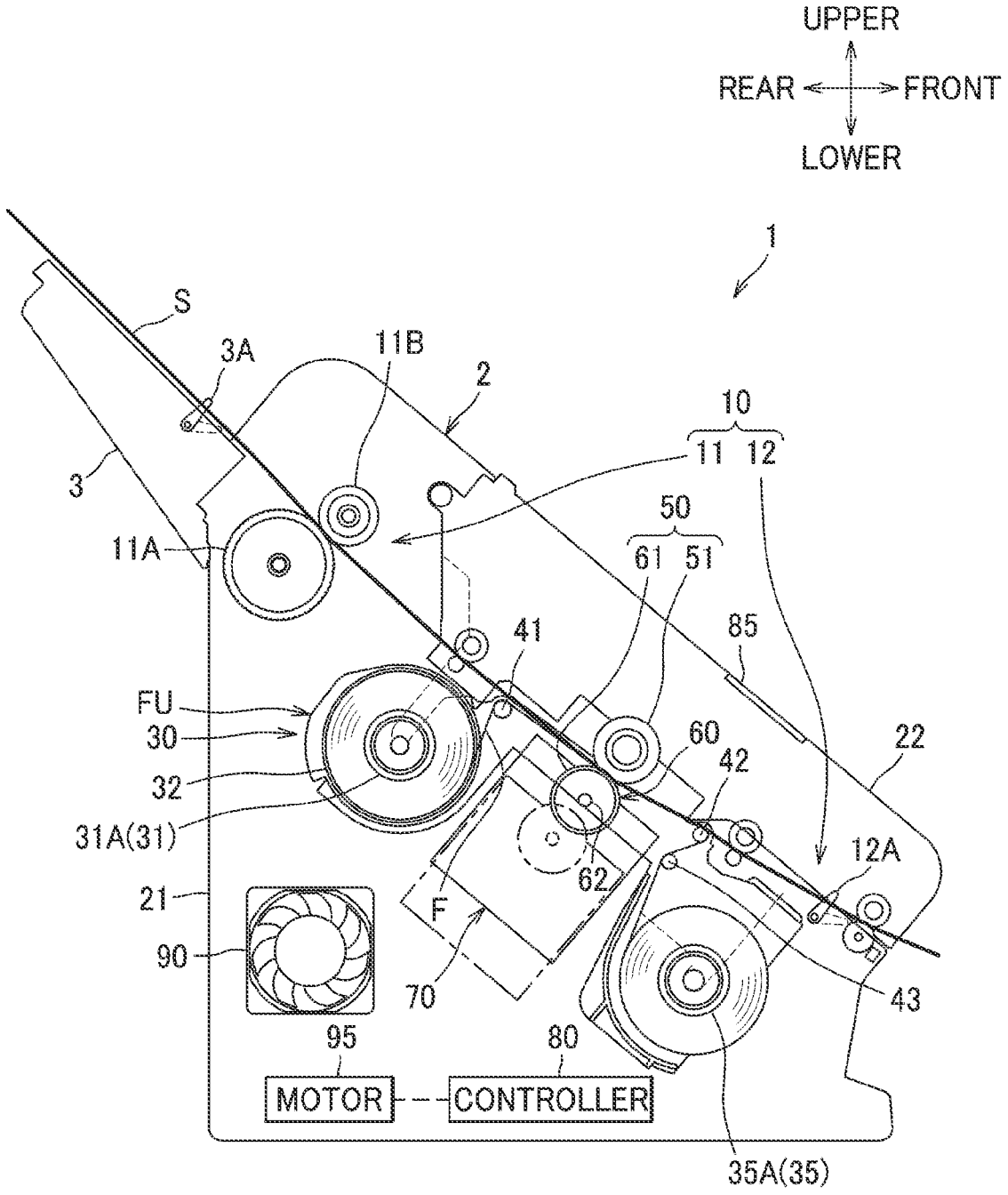
FIG. 8 is a diagram showing a foil transfer device according to a second embodiment.

As shown in FIG. 8, a foil transfer device 1 according to the second embodiment is capable of executing a foil transfer process in which a sheet S having a toner image formed thereon is laid on a foil film F and conveyed to cause a transfer layer to be transferred onto the toner image formed on the sheet S. The foil transfer device 1 includes a housing 2, a sheet tray 3, a sheet conveyor unit 10, a film supply unit 30, a transfer unit 50, a controller 80, a fan 90, and a motor 95.

The housing 2 is made of plastic or the like, and includes a housing main body 21 and a cover 22. The housing main body 21 has an opening 21A at its upper side (see FIG. 9). The opening 21A has a size large enough to allow a film unit FU to pass therethrough. The housing main body 21 further includes a first guide GD1 and a second guide GD2, which hold the film unit FU in a manner that permits the film unit FU to be installed into and removed from the housing main body 21. The cover 22 is a member for opening and closing the opening 21A. A rear end portion of the cover 22 is rotatably supported by the housing main body 21. The cover 22 is configured to be swingable between a closed position in which the opening 21A is closed (position shown in FIG. 8) and an open position in which the opening 21A is open (position shown in FIG. 9).

The sheet tray 3 is provided with a sheet sensor 3A. The seat sensor 3A is swingable to a non-detection position indicated by a solid line and to a detection position indicated by a chain line, and capable of detecting whether or not a sheet S is placed on the sheet tray 3.

The sheet conveyor unit 10 includes a sheet feed mechanism 11 and a sheet ejection mechanism 12. The sheet feed mechanism 11 includes a pickup roller 11A and a retard roller 11B. The sheet ejection mechanism 12 includes a plurality of conveyor rollers and a sheet sensor 12A. The sheet sensor 12A is swingable to a non-detection position indicated by a solid line and to a detection position indicated by a chain line, and capable of detecting whether or not a sheet S has been ejected completely.

Figure 9:
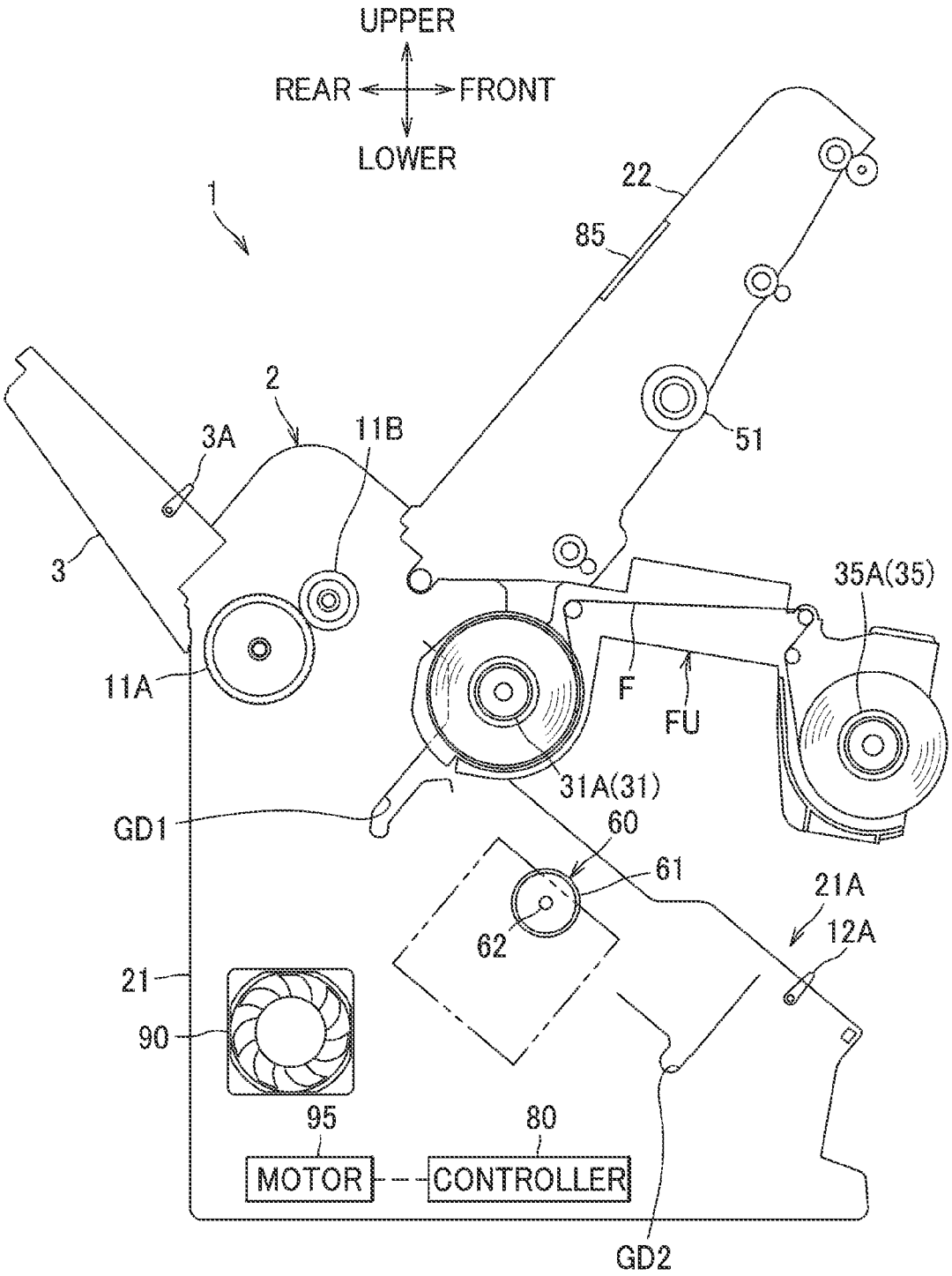
FIG. 9 is a diagram showing an open cover state of the foil transfer device.

The film supply unit 30 includes a film unit FU and a motor 95. The film unit FU includes a supply reel 31, a take-up reel 35, a first guide shaft 41, a second guide shaft 42 as an example of a separator, and a third guide shaft 43. A foil film F is wound on the supply reel 31 of the film unit FU. As shown in FIG. 9, the film unit FU is configured to be installable into and removable from the housing main body 21 through the opening 21A in a direction perpendicular to an axial direction of the supply reel 31.

Figure 10:
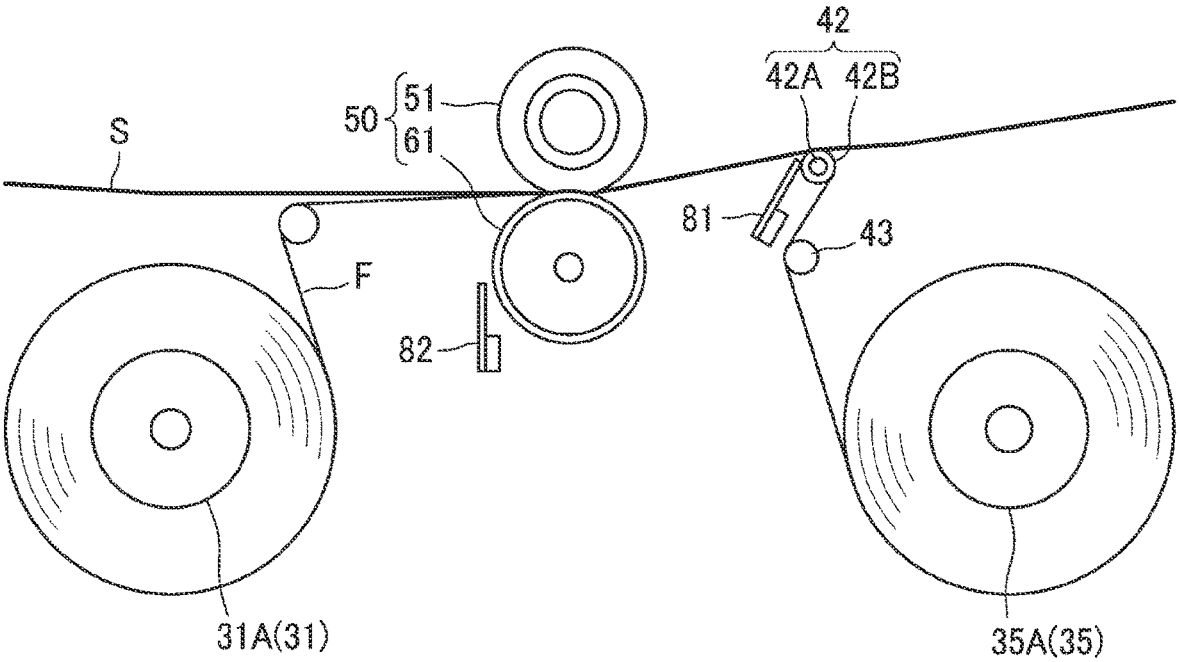
FIG. 10 is a partially enlarged view showing a heat roller and its vicinity in FIG. 8.
Figure 11:
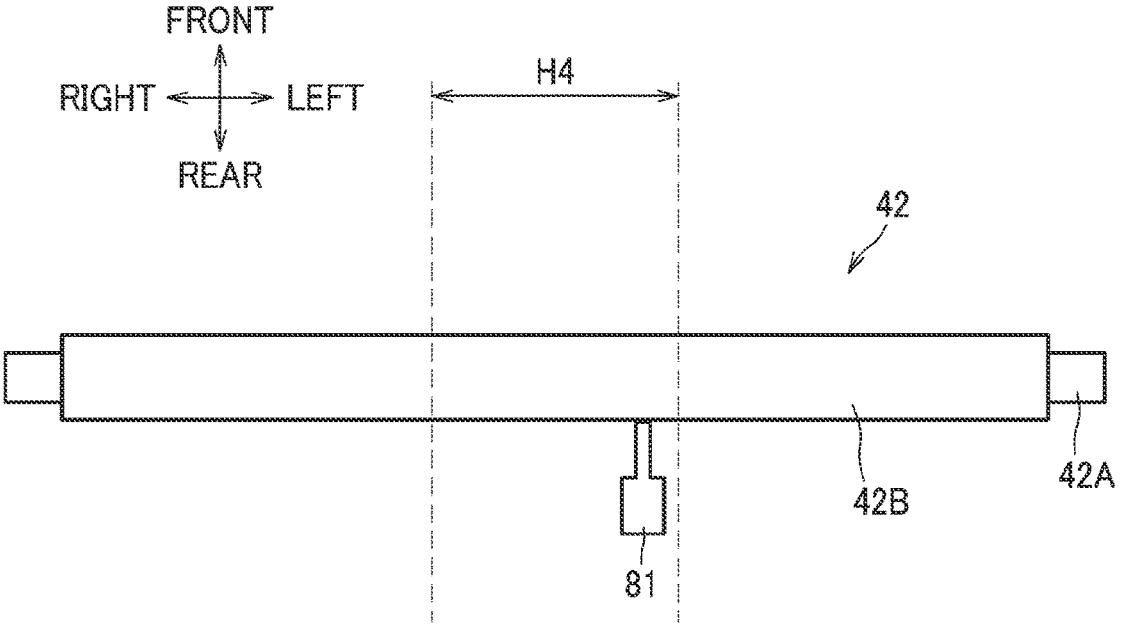
FIG. 11 is a diagram for showing relative positions of a second guide shaft and a thermistor.

As shown in FIG. 10 and FIG. 11, in the present embodiment, the second guide shaft 42 includes a shaft 42A made of stainless steel, and a cover 42B made of plastic. The shaft 42 is covered with the covered 42B. A third temperature detector 81 is provided at the second guide shaft 42. The third temperature detector 81 is capable of detecting a temperature of the second guide shaft 42.

The third temperature detector 81 is a thermistor in contact with the second guide shaft 42. In the present embodiment, the third temperature detector 81 is in contact with the cover 42B. The third temperature detector 81 is located in a position within a region H4 coextensive, in an axial direction of the second guide shaft 42, with a path of a foil transferable minimum-sized sheet S allowed to be conveyed in the foil transfer device 1.

Turning back to FIG. 8, the transfer unit 50 includes a pressure roller 51 and a heating member 60. The heating member 60 includes a heating roller 51 and a heater 62.

In the vicinity of the heating roller 61, a second temperature detector 82 capable of detecting a temperature of the heating roller 61 is provided (see FIG. 10). In the present embodiment, the second temperature detector 82 is a non-contact thermistor that is kept out of contact with the heating roller 61. It is to be understood that the second temperature detector 82 may be of a contact type.

The foil transfer device 1 includes a contact/separation mechanism 70 configured to cause the heating roller 61 to move between a contact position in which the heating roller 61 is in contact with the foil film F and a separate position in which the heating roller 61 is separate from the foil film F. The contact/separation mechanism 70 is configured such that when the cover 22 is in a closed state and the controller 80 executes a foil transfer control process, the heating roller 61 is moved to the contact position and brought into contact with the foil film F. Furthermore, the contact/separation mechanism 70 is configured such that when the cover 22 is open or when the process of transferring foil onto a sheet S is not executed in the transfer unit 50, the heating roller 61 is kept in the separate position separate from the foil film F.

The controller 80 includes a central processing unit (CPU), a read-only memory (ROM), a random-access memory (RAM), a non-volatile memory, etc., and is configured to execute a variety of control processes based on computer programs prepared in advance. Data necessary for the foil transfer control, such as control tables suitable for respective foil films F of the film cartridges F installable in the housing main body 21 are stored in the ROM, the non-volatile memory, etc. When the process of transferring foil onto a sheet S is performed, a user may, for example, operate a control panel 85 provided on the cover 22 of the housing 2, to configure and run a desired foil transfer job. The controller 80 receives a signal from the control panel 85, and executes a foil transfer control process corresponding to the job configured by the user.

The fan 90 is an air blower capable of producing a current of air within the housing main body 21 (i.e., forcing air within the housing main body 21 to flow). In the present embodiment, the fan 90 is provided within the housing main body 21.

Next, the outline of a control process executed by the controller 80 after the power to the foil transfer device 1 is turned on is explained.

When the power to the foil transfer device 1 is turned on, the controller 80 turns the heater 62 on, with the target temperature for the heating roller 61 being set at a ready temperature TR. The ready temperature TR may be set as desired. In the present embodiment, the ready temperature TR is equal to 100 degrees centigrade (TR=100° C.). Once the temperature detected by the second temperature detector 82 exceeds 100° C., the controller 80 performs a feedback control over the heater 62 to keep the detected temperature at 100° C.

Upon receipt of a foil transfer instruction, the controller 80 executes a foil transfer control process.

For the foil transfer control process, the controller 80 sets the target temperature for the heating roller 61 at a first target temperature TH that is higher than the ready temperature TR. The first target temperature TH is a temperature fit for precise transfer of the transfer layer of the foil film F onto a toner image formed on a sheet S. The first target temperature TH may be set as desired according to the kinds of the transfer layers, or the like. In the present embodiment, the first target temperature TH is equal to 150 degrees centigrade (TH=150° C.). Once the temperature detected by the second temperature detector 82 exceeds 150° C., the controller 80 performs a feedback control over the heater 62 to keep the detected temperature at 150° C.

If the controller 80 finds that a temperature acquired from the second temperature detector 82 has reached the first target temperature TH, the controller 80 activates the motor 95 and causes the heating roller 61 to move to the contact position. Consequently, a sheet S on the foil film F is conveyed (i.e., the sheet S and the foil film F passes through between the heating roller 61 and the pressure roller 51) so that the foil transfer process is executed. If the controller 80 finds that the sheet S has been ejected completely and no subsequent sheet S remains on the sheet tray 3, the controller 80 causes the heating roller 61 to move to the separate position and stops the motor 95, thereby bringing the foil transfer process to an end.

If a temperature acquired from the third temperature detector 81 is equal to or higher than a first temperature T1, the controller 80 executes a first cooldown process to cool the second guide shaft 42. In the present embodiment, the first temperature T1 is equal to 70 degrees centigrade (T1=70° C.).

After starting the first cooldown process, the controller 80 monitors the temperature acquired from the third temperature detector 81, and brings the first cooldown process to an end on condition that the temperature acquired from the third temperature detector 81 has become lower than a second temperature T2 that is lower than the first temperature T1. In the present embodiment, the second temperature T2 is equal to 60 degrees centigrade (T2=60° C.).

The controller 80 may be configured to suspend a foil transfer control process for the first cooldown process. If the foil transfer control process has been suspended before commencement of the first cooldown process, the controller 80 restarts the suspended foil transfer control process after the end of the first cooldown process.

The controller 80 is configured to cause the fan 90 to revolve at a second speed V2 slower than a first speed V1 (the speed at which the fan 90 is caused to revolve during the first cooldown process) before the temperature acquired from the third temperature detector 81 has become equal to or higher than the first temperature T1. To be more specific, the controller 80 is configured to cause the fan 90 to revolve at the second speed V2 if the temperature acquired from the third temperature detector 81 is equal to or higher than a third temperature T3 lower than the first temperature T1.

The controller 80 is configured to stop the fan 90 if the temperature acquired from the third temperature detector 81 has become lower than a temperature that is lower than the second temperature T2 and lower than the third temperature T3.

The third temperature T3 may be either a temperature not lower than the second temperature T2 or a temperature lower than the second temperature T2. In the present embodiment, the third temperature T3 is 65° C., that is, lower than the first temperature T1 and higher than the second temperature T2. In the present embodiment, the first speed V1 is a full speed that is the fastest possible speed of the fan 90, while the second speed V2 is a half speed that is half the full speed of the fan 90.

The first cooldown process is a process which may include a process of reducing an amount of conveyance of sheets S per unit time and/or a process of causing the fan 90 to revolve at the first speed V1.

The process of reducing an amount of conveyance of sheets per unit time is a process by which the foil transfer duty is lowered. To be more specific, as the process of reducing the amount of conveyance of sheets S per unit time, the controller 80 executes either one or both of the following two processes: a process of lengthening an interval between times at which sheets S are to be conveyed; and a process of slowing the speed of conveyance of the sheets S. The process of lengthening a interval between times at which sheets S are to be conveyed may include suspending the conveyance of sheets S. When the conveyance of sheets S is to be suspended, the controller 80 may continue the foil transfer process in the interim for the sheets S remaining in the housing main body 21 and already being subjected to the foil transfer process, until these sheets S are ejected to the outside of the housing main body 21.

In the present embodiment, the controller 80 is configured to cause the fan 90 to revolve at the first speed V1 and suspend the supply/conveyance of sheets S, for the first cooldown process. After causing sheets S, if any, remaining in the housing main body 21, to be ejected to the last, the controller 80 causes the heating roller 61 to move to the separate position, and turns off the motor 95. In other words, the controller 80 is configured to execute the first cooldown process in a state where the heating roller 61 is separate from the foil film F.

The controller 80 is further configured to execute a second cooldown process to cool the heating roller 61 down if the temperature acquired from the second temperature detector 82 is equal to or higher than a fourth temperature T4 that is higher than the first temperature T1. In the present embodiment, the fourth temperature T4 is equal to 195 degrees centigrade (T4=195° C.).

After starting the second cooldown process, the controller 80 monitors the temperature acquired from the second temperature detector 82, and brings the second cooldown process to an end on condition that the temperature acquired from the second temperature detector 82 has become lower than a fifth temperature T5 that is lower than the fourth temperature T4. In the present embodiment, the fifth temperature T5 is equal to 160 degrees centigrade (T5=160° C.).

In the present embodiment, the second cooldown process is substantially the same process as the first cooldown process, and a duplicate description thereof will be omitted.

Figure 12:
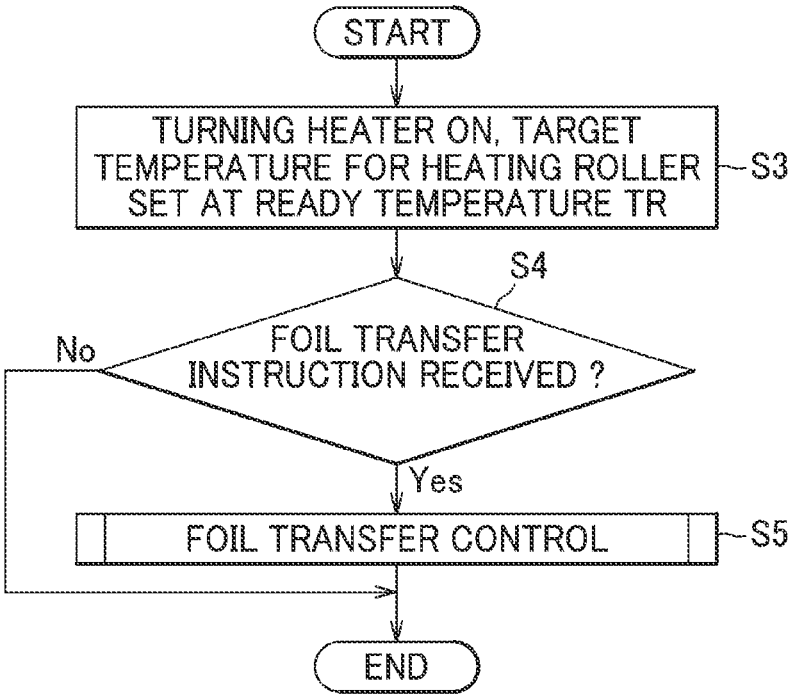
FIG. 12 is a flowchart showing a control process to be executed by a controller upon power-up in the second embodiment.
Figure 13:
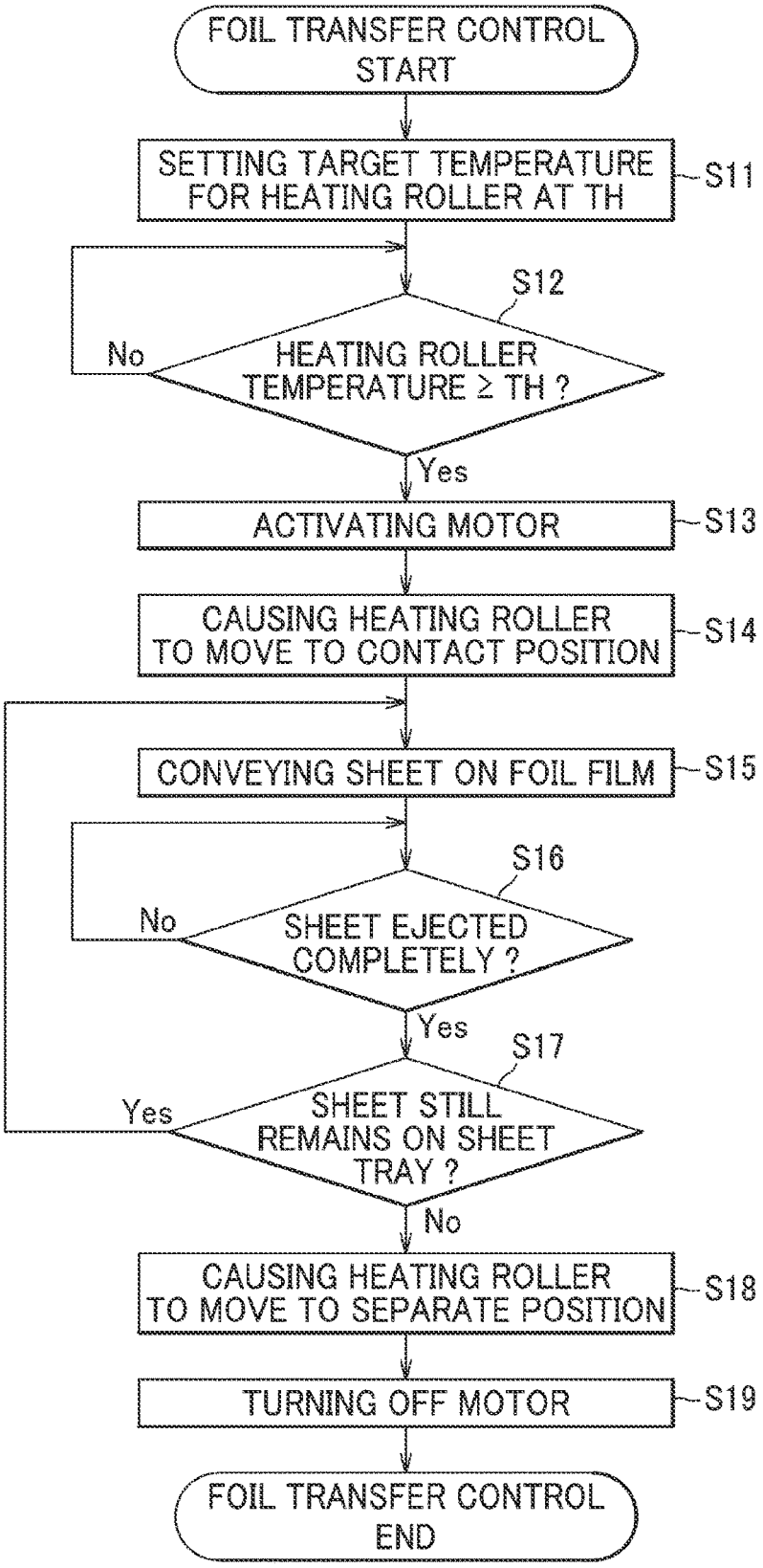
FIG. 13 is a flowchart showing a foil transfer control.

Next, referring to flowcharts shown in FIGS. 12 to 15, a description will be given of one example of the process of the controller 80 according to the present embodiment The flowcharts of FIG. 12 and FIG. 13 show the process steps of a foil transfer control process to be executed upon power-up.

As shown in FIG. 12, upon power-up of the foil transfer device 1, the controller 80 turns on the heater 62 with the target temperature for the heating roller 61 being set at the ready temperature TR (S3). The controller 80 makes a determination as to whether a foil transfer instruction is received (S4).

If it is determined in step S4 that no foil transfer instruction is received (No in step S4), then the controller 80 brings the process to an end.

If it is determined in step S4 that a foil transfer instruction has been received (Yes in step S4), then the controller 80 executes the foil transfer control process (S5), and eventually brings the process to an end.

Next, the foil transfer control process is discussed in detail.

As shown in FIG. 13, at the start of the foil transfer control, the controller 80 sets the target temperature for the heating roller 61 at a first target temperature TH (S11).

After step S11, the controller 80 makes a determination as to whether or not the temperature of the heating roller 61 is equal to or higher than the first target temperature TH, i.e., the temperature detected by means of the second temperature detector 82 is equal to or higher than the first target temperature TH (S12).

If it is determined in step S12 that the temperature of the heating roller 61 is not equal to or higher than the first target temperature TH (No, in step S12), then the controller 80 waits until the temperature of the heating roller 61 becomes equal to or higher than the first target temperature TH.

On the other hand, if it is determined in step S12 that the temperature of the heating roller 61 is equal to or higher than the first target temperature TH (Yes in step S12), then the controller 80 activates the motor 95, and causes the heating roller 61 which is connected to the motor 95 via a gear train (not shown) to rotate (S13). The controller 80 further causes a mechanical force produced by the motor 95 to be transmitted to the contact/separation mechanism 70 which in turn causes the heating roller 61 to move to the contact position (S14).

In sync with the process in step S14, the controller 80 causes a sheet S to be fed onto and conveyed with the foil film F (S15) to perform a foil transfer.

After step S15, the controller 80 makes a determination as to whether or not the sheet S has been ejected completely (S16), and if it is determined in step S16 that the sheet S has not yet been ejected completely (No in step S16), then the controller 80 waits until the sheet S has been ejected completely, while if it is determined in step S16 that the sheet S has been ejected completely (Yes in step S16), then the controller 80 makes a determination as to whether or not sheet(s) S still remains on the sheet tray 3 (S17).

If it is determined in step S17 that one or more sheets S still remain on the sheet tray 3 (Yes in step S17), then the controller 80 repeats the process steps starting from step S15 to continue to execute the foil transfer process.

If it is determined in step S17 that no sheet S remains on the sheet tray 3 (No in step S17), then the controller 80 causes the heating roller 61 to move to the separate position (S18), turns off the motor 95 (S19), and brings the foil transfer control process to an end.

Referring now to the flowcharts of FIG. 14 and FIG. 15, a description will be given of a process, executed after the power-up, for the cooldown process. When the foil transfer device 1 is being powered, the controller 80 repeatedly executes the process steps S21 to S32.

Figure 14:
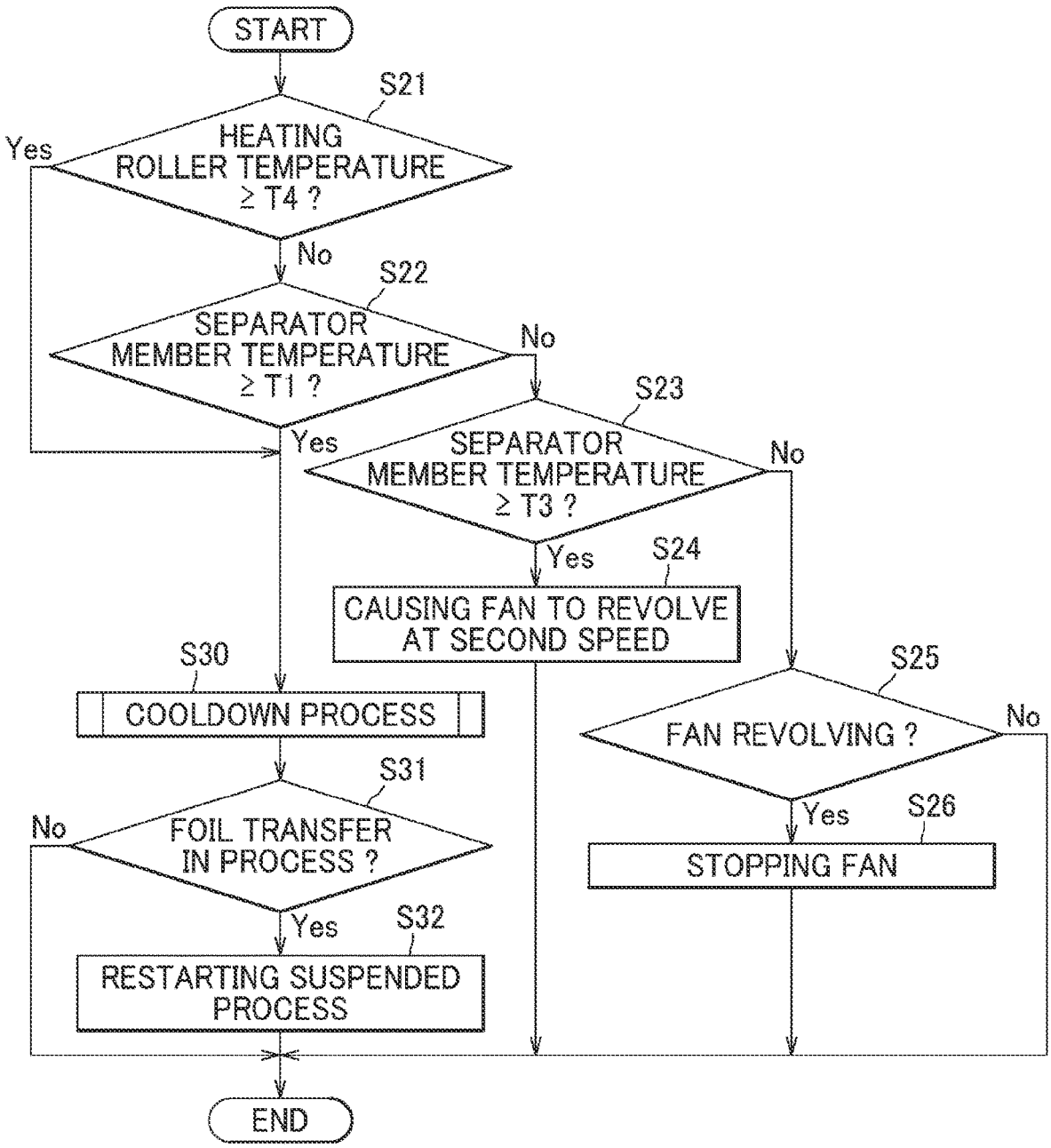
FIG. 14 is a flowchart showing a control process, including a cooldown process, to be executed by the controller in the second embodiment.

As shown in FIG. 14, the controller 80 makes a determination as to whether or not the temperature of the heating roller 61 is equal to or higher than the fourth temperature T4 (S21). If it is determined in step S21 that the temperature of the heating roller 61 is equal to or higher than the fourth temperature T4 (Yes in step S21), then the controller 80 proceeds to execute the cooldown process (S30).

On the other hand, if it is determined in step S21 that the temperature of the heating roller 61 is not equal to or higher than the fourth temperature T4 (No in step S21), then the controller 80 makes a determination as to whether or not the temperature of the second guide shaft 42 (separator) is equal to or higher than the first temperature T1, i.e., the temperature detected by means of the second temperature detector 82 is equal to or greater than the first target temperature TH (S22).

If it is determined in step S22 that the temperature of the second guide shaft 42 is equal to or higher than the first temperature T1 (Yes in step S22), then the controller 80 proceeds to execute the cooldown process (S30), and if it is determined in step S22 that the temperature of the second guide shaft 42 is not equal to or higher than the first temperature T1 (No in step S22), then the controller 80 makes a determination as to whether or not the temperature of the second guide shaft 42 is equal to or higher than the third temperature T3 (S23).

If it is determined in step S23 that the temperature of the second guide shaft 42 is equal to or higher than the third temperature T3 (Yes in step S23), then the controller 80 causes the fan 90 to revolve at the second speed V2 (S24), and brings the process to an end.

On the other hand, if it is determined in step S23 that the temperature of the second guide shaft 42 is not equal to or higher than the third temperature T3 (No in step S23), then the controller 80 makes a determination as to whether or not the fan 90 is revolving (S25). If it is determined in step S25 that the fan 90 is revolving (Yes in step S25), then the controller 80 stops the fan 90 (S26), while if it is determined in step S25 that the fan 90 is not revolving (No in step S25), then the controller 80 brings the process to an end.

After step S30, the controller 80 makes a determination as to whether or not the foil transfer control was in process before commencement of the first cooldown process (S31).

If it is determined in step S31 that the foil transfer control was not in process before commencement of the first cooldown process (No in step S31), then the controller 80 brings the process to an end.

If it is determined in step S31 that the foil transfer control was in process before commencement of the first cooldown process (Yes in step S31), then the controller 80 restarts the suspended process, that is, the foil transfer control (S32), and brings this process to an end.

Next, the cooldown process will be described.

Figure 15:
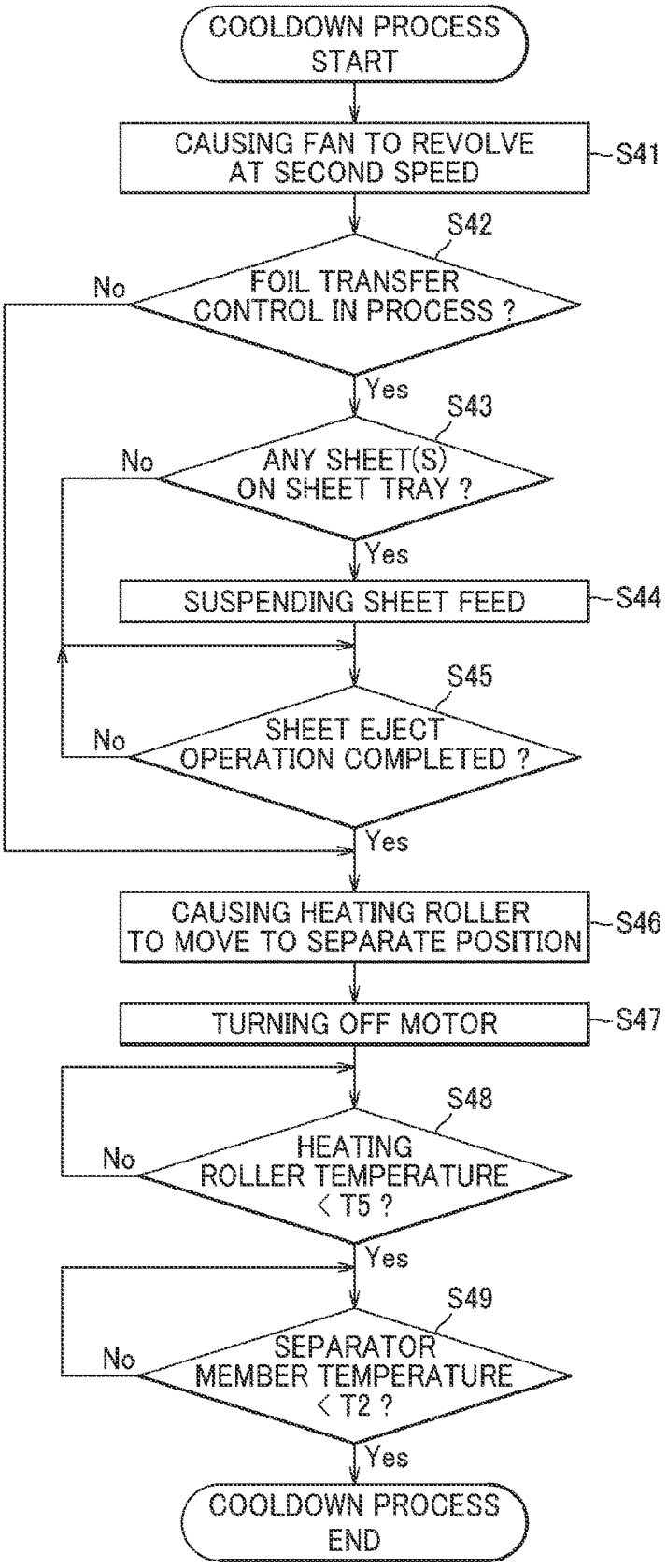
FIG. 15 is a flowchart showing the cooldown process.

As shown in FIG. 15, to execute the cooldown process, the controller 80 causes the fan 90 to revolve at a first speed V1 (S41), and makes a determination as to whether the foil transfer control is in process (S42).

If it is determined in step S42 that the foil transfer control is not in process (No in step S42), then the controller 80 proceeds to execute the process in step S46, while if it is determined in step S42 that the foil transfer control is in process (Yes in step S42), then the controller 80 makes a determination as to whether or not there is any sheet(s) S remaining on the sheet tray 3 (S43).

If it is determined in step S43 that there is one or more sheets S on the sheet tray 3 (Yes in step S43), then the controller 80 suspends the sheet feed operation (S44), and proceeds to step S45.

If it is determined in step S43 that there is no sheet S on the sheet tray 3 (No in step S43), or after completion of the process in step S44 (if determination in step S43 turns out to be Yes), the controller 80 makes a determination as to whether or not the sheet eject operation has been completed, i.e., whether or not there is any sheet(s) S already fed but not yet ejected completely (S45).

If it is determined in step S45 that the sheet eject operation has not been completed (No in step S45), then the controller 80 waits until the sheet eject operation is complete, while if it is determined in step S45 that the sheet eject operation has been completed (Yes in step S45), then the controller 80 proceeds to execute the process in step S46.

The controller 80, in step S46, exercises control over the contact/separation mechanism 70 to cause the heating roller 61 to move to the separate position (S46). The controller 80 then turns off the motor 95 to stop rotation of the heating roller 61 (S47), and makes a determination as to whether or not the temperature of the heating roller 61 is lower than the fifth temperature T5 (S48).

If it is determined in step S48 that the temperature of the heating roller 61 is not lower than the fifth temperature T5 (No in step S48), then the controller 80 waits until the temperature of the heating roller 61 becomes lower than the fifth temperature T5. On the other hand, if it is determined in step S48 that the temperature of the heating roller 61 is lower than the fifth temperature T5 (Yes in step S48), then the controller 80 makes a determination as to whether or not the temperature of the second guide shaft 42 (separator) is lower than the second temperature T2 (S49).

If it is determined in step S49 that the temperature of the second guide shaft 42 is not lower than the second temperature T2 (No in step S49), then the controller 80 waits until the temperature of the second guide shaft 42 becomes lower than the second temperature T2. On the other hand, if it is determined in step S49 that the temperature of the second guide shaft 42 is lower than the second temperature T2 (Yes in step S49), then the controller 80 brings the cooldown process to an end.

With the foil transfer device 1 as described above, the following advantageous effects can be achieved.

The foil transfer device 1 includes the second guide shaft 42 as a separator configured to separate the foil film F from the sheet S. If the second guide shaft 42 becomes hot (i.e., the temperature of the second guide shaft 42 becomes high), the transfer layer would soften up and lose crispness, and cause degradation in the quality of an image of the transferred foil.

With this in view, the foil transfer device 1 includes the third temperature detector 81 capable of detecting the temperature of the second guide shaft 42, and the controller 80 executes the first cooldown process in which if the temperature acquired from the third temperature member 81 is equal to or higher than the first temperature T1, the second guide shaft 42 is cooled down. Therefore, the second guide shaft 42 is restrained from becoming too hot, and the degradation in the quality of an image formed with the transferred foil can be restricted.

Since the controller 80 starting the first cooldown process delays the end of the first cooldown process until the temperature acquired from the third temperature detector 81 becomes lower than the second temperature T2 that is lower than the first temperature T1, an undesirable rise in the temperature of the second guide shaft 42 back to the first temperature T1 or even higher shortly after the end of the first cooldown process can be made unlikely to take place.

Since the controller 80 executing the first cooldown process causes the heating roller 61 to be separated from the foil film F, the execution time of the first cooldown process can be shortened.

Further, the controller 80 executes the second cooldown process in which if the temperature acquired from the second temperature detector 82 is equal to or higher than the fourth temperature T4 that is higher than the first temperature T1, the heating roller 61 is cooled down. Accordingly, the heating roller 61 is restrained from becoming too hot, and the degradation in the quality of an image formed with the transferred foil can be restricted.

Since the second guide shaft 41 has the plastic cover with which the metal shaft is covered, inadvertent contact of a user with the second guide shaft 41 would not make the user hurt so seriously by heat.

The third temperature detector 42 is located in a position within a region H4 coextensive, in an axial direction of the second guide shaft 42, with a path of a foil transferable minimum-sized sheet allowed to be conveyed in the foil transfer device 1. Accordingly, the third temperature detector 81 can acquire the temperature of a portion at which the foil is transferred, with the result that the temperature can be controlled adequately.

Next, a third embodiment will be described below.

The second embodiment described above includes the controller 80 which causes the fan 90 to revolve at the second speed V2 that is slower than the first speed V1, if the temperature acquired from the third temperature detector 81 is equal to or higher than the third temperature T3 that is lower than the first temperature T1. In contrast, the third embodiment is different from the second embodiment in that the fan 90 is caused to revolve at the second speed V2 on condition that the power has been turned on.

Further, in the third embodiment, even if the temperature of the second guide shaft 42 becomes lower than the third temperature T3, the fan 90 is not stopped and caused to revolve at the second speed V2. Similarly, even after the end of the first cooldown process or the second cooldown process, the fan 90 is not stopped and caused to revolve at the second speed V2.

Referring now to the flowcharts shown in FIG. 16 and FIG. 17, one example of the process of the controller 80 according to the third embodiment will be described below. In describing the flowchart of FIG. 16, only the steps different from those of the process shown in FIG. 12 are brought into focus; in describing the flowchart of FIG. 17, only the steps different from those of the process shown in FIG. 14 are brought into focus.

Figure 16:
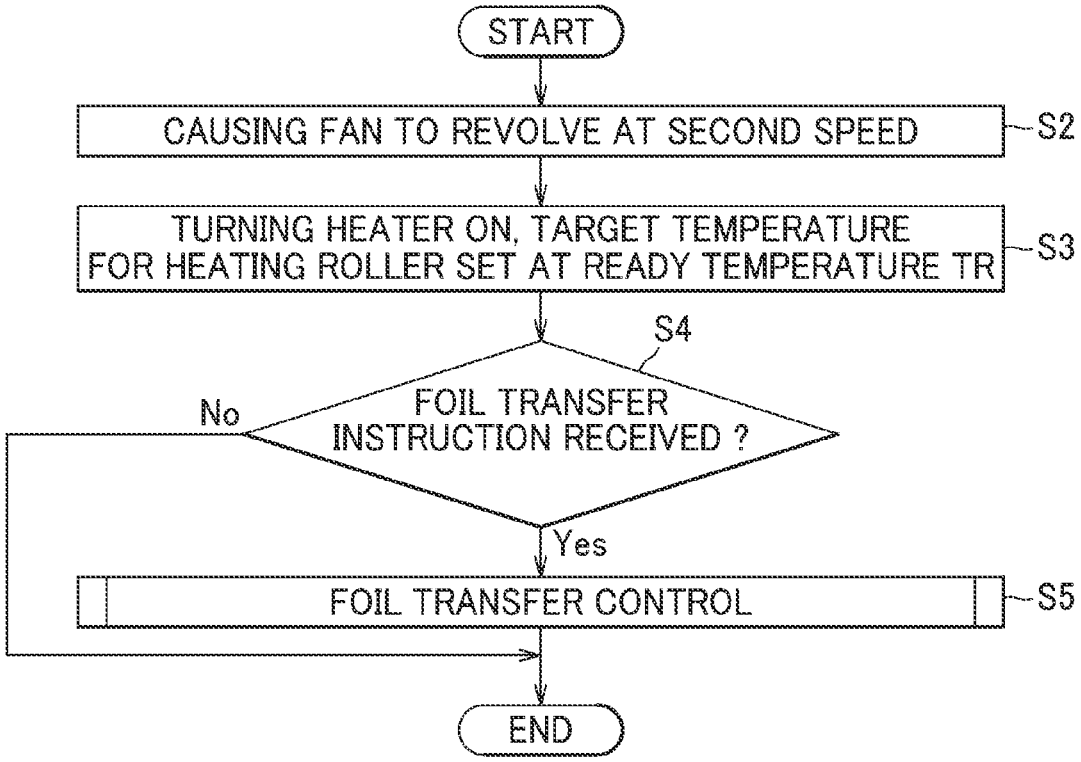
FIG. 16 is a flowchart showing a control process to be executed by a controller upon power-up in a third embodiment.

As shown in FIG. 16, in the third embodiment, when the power to the foil transfer device 1 is turned on, the controller 80 causes the fan 90 to revolve at the second speed V2 (S2). Following the step S2, the controller 80 executes the same process steps as in the second embodiment.

Figure 17:
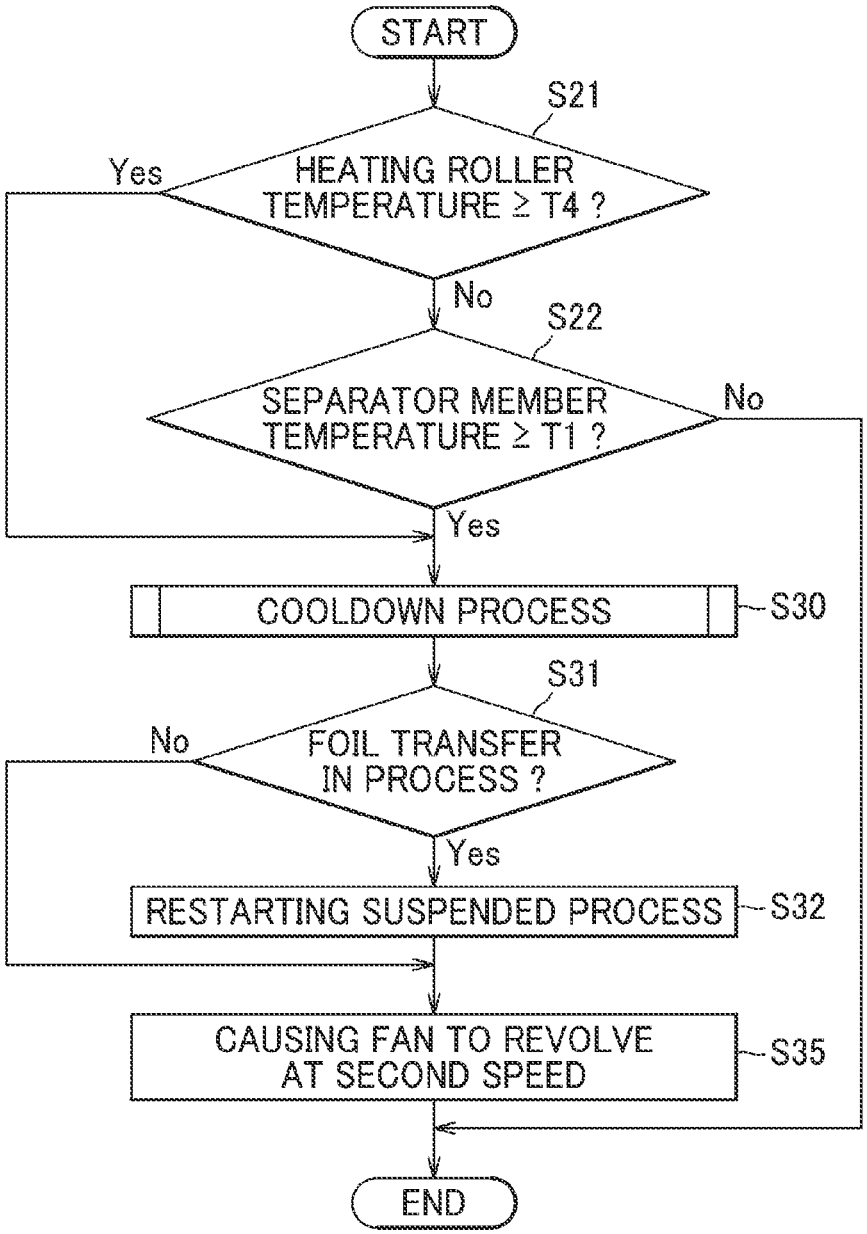
FIG. 17 is a flowchart showing a control process, including a cooldown process, to be executed by the controller in the third embodiment.

As shown in FIG. 17, in the third embodiment, if it is determined in step S22 that the temperature of the second guide shaft 24 is not equal to or higher than the first temperature T1 (No in step S22), then the controller 80 brings the process to an end.

Further, in the third embodiment, if it is determined in step S31 that the foil transfer control was not in process before commencement of the first cooldown process or the second cooldown process (No in step S31), or (if the foil transfer control was in process which has temporarily been suspended) after restarting the suspended foil transfer control process in step S32, the controller 80 causes the fan 90 to revolve at the second speed V2 (S35), and brings the process to an end.

In this third embodiment, like the second embodiment, the second guide shaft 42 can be restrained from becoming too hot, i.e., equal to or higher than the first temperature T1, and thus the degradation in the quality of an image formed with the transferred foil can be restricted.

The second embodiment and the third embodiment as described above may be modified where appropriate in specific configurations.

For example, although the second embodiment and the third embodiment are configured to have the second guide shaft 42 as an example of the separator made up of the shaft 42A of stainless steel and the cover 42B of plastic, and the shaft 42A is covered with the cover 42B, the shaft may not necessarily be made of stainless steel, but may be of other kind of metal, or even of a material other than metal. Furthermore, the cover with which the shaft is covered may not be provided. In this alternative configuration, the third temperature detector may be in contact with the shaft which may be made of stainless steel or other material.

Although the second embodiment and the third embodiment are each configured to have a thermistor as the third temperature detector or the second temperature detector, each of the third temperature detecting sensor and the second temperature sensor may be an infrared sensor or a thermocouple.

In the above described embodiments, the sheet sensor 3A provided at the sheet tray 3 and the sheet sensor 12A provided at the sheet ejection mechanism 12 are each illustrated as a contact-type sensor contactable with a sheet S, but the sheet sensor 3A and the sheet sensor 12A may be of a noncontact type.

In the above described embodiment, the second cooldown process is described as substantially the same process as the first cooldown process, but the second cooldown process may be different from the first cooldown process.

Although the second embodiment and the third embodiment are each configured to have the fan 90 provided within the housing main body, the fan may be provided at any position within the housing, for example, within the cover, outside of the housing main body or outside of the cover, as long as the fan can produce a current of air (to force air to flow) within the housing. To force air to flow within the housing, a single fan may suffice, but more than one fan may be provided where appropriate.

For example, in a specific configuration illustrated as the first embodiment with the first fan 91 configured to blow air toward the foil film F positioned between the heating member (heating roller 61) and the separator (second guide shaft 42), as well, the third temperature detector 81 capable of detecting the temperature of the separator and the controller configured to execute the cooldown process based on the temperature acquired from the third temperature detector may be provided.

Further, the control exercised by the controller to execute the cooldown process may be implemented in a configuration having no third temperature detector 81 capable of detecting the temperature of the separator. The following description of a fourth embodiment, made with reference to FIG. 18, is directed to one example of a control process in an exemplary configuration having the first fan 91 and the second fan 92 as described in the first embodiment but not having the third temperature detector capable of detecting the temperature of the separator.

Figure 18:
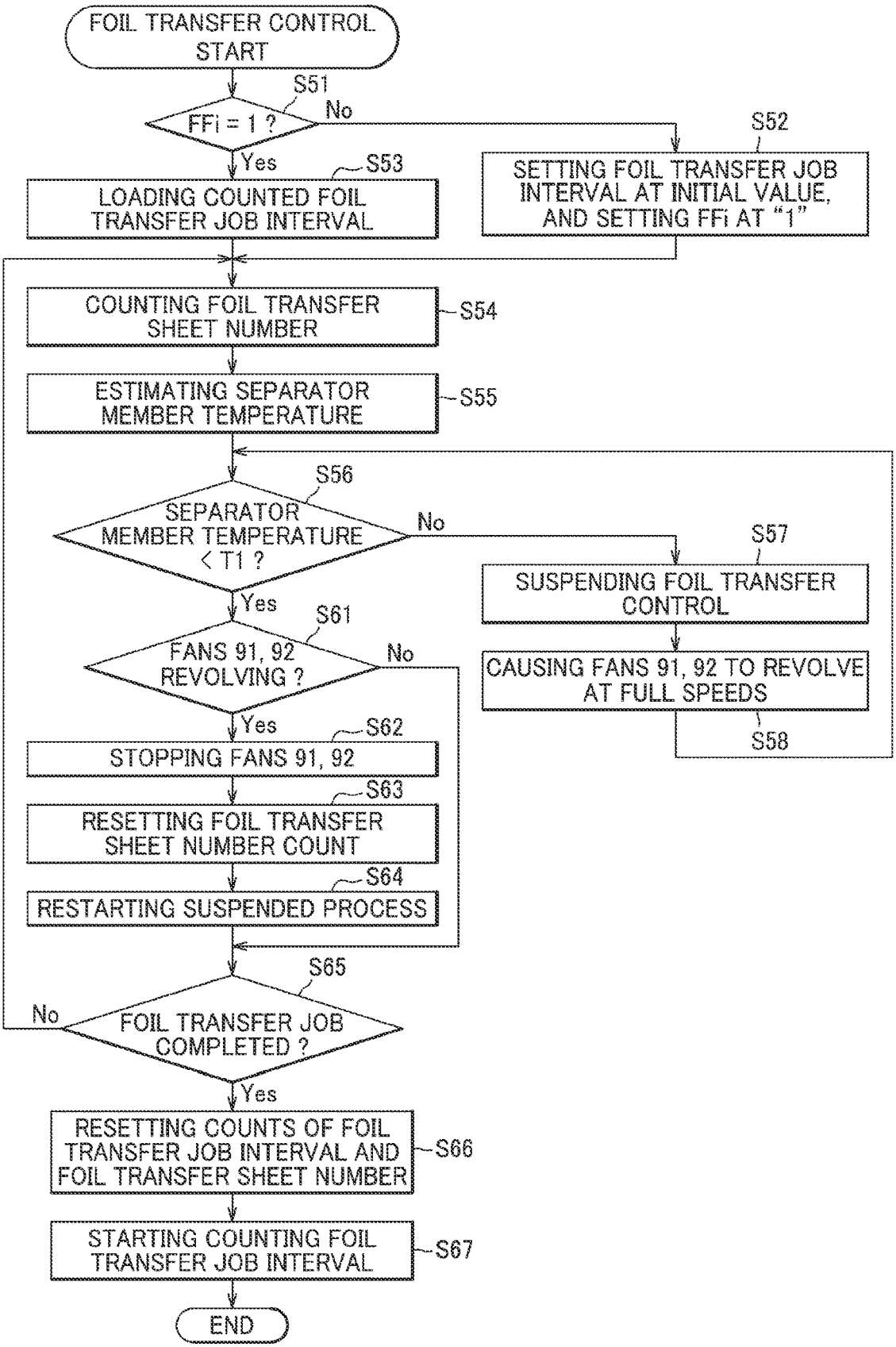
FIG. 18 is a flowchart showing a control process, including a cooldown process, to be executed by the controller in a fourth embodiment.

In this embodiment shown in FIG. 18, the controller 80 utilizes a heating roller temperature THe (the temperature of the heating roller 61 as acquired from the second temperature detector 82), a set conveyance speed VSt, a foil transfer sheet number NSt (the number of sheets as counted based on a signal generated by the sheet sensor 12A detecting a sheet S being ejected), and a foil transfer job interval Fi (the idle time between foil transfer jobs), to estimate a temperature of the separator. Herein, the foil transfer sheet number NSt is the number of sheets subjected to the foil transfer process executed continuously without suspension as effected by the cooldown process. The foil transfer job refers to a unit foil transfer process executed continuously on a batch of sheets (sheets of which the number is set by a user or all the sheets placed on the sheet tray 3) until all the sheets in the batch are conveyed and processed for foil transfer.

In this embodiment, the timing of activation of the first fan 91 and the second fan 92 under the foil transfer control is determined based on the estimated separator temperature obtained by Eq. 1:

$$\text{Estimated separator temperature} = A \times THe + B \times NSt \times VSt + C \times Fi \quad \text{Eq. 1}$$

where A is a coefficient determined by a contribution rate of the heating roller temperature THe to the separator temperature (temperature rise factor); B is a coefficient determined by a contribution rate of sheets going past the separator at the conveyance speed VSt to the separator temperature per the foil transfer number NSt (temperature rise factor); C is a coefficient determined by a contribution rate of the foil transfer job interval Fi to the separator temperature (heat dissipation factor). The coefficients A and B are positive constants, and the coefficient C is a negative constant. The coefficients A, B and C are predetermined based on simulation or the like and stored in advance. The variables THe, NSt, VSt, and Fi for estimation of the separator temperature are stored in advance and updated on as-needed basis.

In the foil transfer device 1 according to the present embodiment, the controller 80 uses an interval flag FFi to make a determination at the start of a foil transfer job as to whether it is the first job to be executed for the first time after the power-up of the foil transfer device 1 or there has been a preceding job executed previously. The controller 80 has a region for the interval flag FFi in its nonvolatile memory, and is configured to set "0" upon powering off, and to set "1" at the time of execution of the foil transfer job. In addition, the controller 80 stores a predetermined value as a foil transfer job interval Fi upon power-up i.e., an initial value to be set when the power is turned on.

At the start of the foil transfer control process, in order to determine a value of the foil transfer job interval Fi, the controller 80 first confirms whether or not the interval flag FFi is set at "1" (S51). If it is confirmed No in step S51 i.e., FFi is not "1" (No, in step S51), then the controller 80 sets the foil transfer job interval Fi at the initial value and sets the interval flag FFi at "1" (S52). On the other hand, if FFi=1 in step S51 (Yes in step S51), then the controller 80 loads the counted (measured) foil transfer job interval Fi into its RAM (S53).

The controller 80 counts up (increments) the foil transfer sheet number NSt each time when a sheet S has been ejected, based on a signal generated by the sheet sensor 12A detecting the sheet S (S54), and estimates the separator temperature (S55). Here, the controller 80 uses the foil transfer job interval Fi determined as described above and the foil transfer sheet number NSt counted as described above, as well as the values of the heating roller temperature THe and the conveyance speed VSt, to estimate the separator temperature, based on Eq. 1.

Subsequently, the controller 80 makes a determination as to whether or not the estimated separator temperature is lower than a first temperature T1 (S56). If the separator temperature turns out to be not lower than the first temperature T1 (No in step S56), then the controller 80 suspends the foil transfer control process (S57), and executes the cooldown process to cause the fans 91, 92 to revolve at full speeds (S58), and then brings the process back to step S56.

On the other hand, if the separator temperature turns out to be lower than the first temperature T1 (Yes in step S56), then the controller 80 makes a determination as to whether or not the fans 91, 92 are revolving (S61). If it turns out that the fans 91, 92 are not revolving (No in step S61), then the process goes to S65; if it turns out that the fans 91, 92 are revolving (Yes in step S61), then the controller stops the fans 91, 92 (S62), resets the foil transfer sheet number count to "0" (S63), restarts the suspended foil transfer process (S64), and then proceeds to step S65. The operations restarted in step S64 include the restart of heating by the motor 95 causing the heating roller 61 to rotate and the contact/separation mechanism 70 to move the heating roller 61 to the contact position in which the heating roller 61 is in contact with the foil film F, the restart of supplying the foil film F by the film supply unit 30, and the restart of conveying a sheet S by the sheet conveyor unit 10.

In step S65, the controller 80 makes a determination as to whether or not the foil transfer job has been completed, and if it turns out that the foil transfer job has not been completed (No in step S65), then goes back to step S54, executing the foil transfer process for the subsequent sheet S, and estimates the separator temperature (S54), to make a determination as to whether a cooldown process is necessary.

If it is determined in step S65 that the foil transfer job has been completed (Yes in S65), then the controller 80 resets the counts of the foil transfer job interval Fi and the foil transfer sheet number NSt to "0" (S66) and starts the count of the foil transfer job interval Fi (S67), and brings the foil transfer control process for this foil transfer job to an end.

If the power to the foil transfer device 1 is not turned off, and a foil transfer control process for the subsequent foil transfer job is started, the interval flag FFi is set at "1" (Yes in step S51); thus, the counted foil transfer job interval Fi is utilized (S53).

In the fourth embodiment, the estimation made of the temperature of the second guide shaft 42 as the separator enables the cooldown process to be executed effectively for the second guide shaft 42. In this way, the second guide shaft 42 can be restrained from becoming too hot, so that the degradation in the quality of an image formed with the transferred foil can be restricted.

It is to be understood that in a specific configuration with the first fan 91 and the second fan 92 as in the first embodiment, if it further includes the third detector capable of detecting the temperature of the separator, the control process can be executed without the steps S55, S51 to S54, S61, and S66 to S67 in the flowchart of FIG. 18, for the separator temperature estimation and associated foil transfer job interval setting and counting and count-resetting of the foil transfer sheet number.

The above-described embodiments are configured as including the heating roller 61 for an element of the heating member, but the heating member may not include a heating roller but may include a film or a belt, instead. The heater 62 provided for an element of the heating member may not only be located inside the roller (or film or belt) but also be located outside the roller (or film or belt).

The process speed for fixing the transfer layer transferred on a sheet is not mentioned above and described on the premise that the process speed is not changed; however, the process speed may be changed depending on the kind of transfer layer (foil). Alternatively or additionally, the process speed may be changed depending on the material and/or thickness of the transfer layer.

For example, the controller 80 may be configured to make a determination as to whether or not the transfer layer includes a metal foil, and if it is determined that the transfer layer includes the metal foil, then sets the process speed at P1, and if it is determined that the transfer layer includes no metal foil, then sets the process speed at P2 that is slower than P1.

In the above-described embodiments, the second guide shaft as the separator is provided in the film unit, but the second guide shaft may be provided in the housing main body.

In the above-described embodiments, the foil transfer device 1 is configured to have its heating member movable by means of the contact/separation mechanism, but alternatively, the pressure member may be configured to be movable, or both of the heating member and the pressure member may be configured to be movable, with a modified contact/separation mechanism.

In the above-described embodiments, the foil transfer device is configured to transfer a transfer layer onto a toner image formed on a sheet, but the foil transfer device may be configured otherwise as long as the foil transfer device transfers a transfer layer onto a sheet. For example, the foil transfer device may be configured to include a thermal head as a heating member.

In the above-described embodiments, the film cartridge FC is configured to be installable into and removable from the holder 100, and the film cartridge FC installed in the holder 100 can be removably installable into the housing main body; however, the film cartridge may be configured to be removably installable directly in the housing main body.

In the above-described embodiments, a shaft-shaped member (second guide shaft 42) is illustrated as an example of the separator; however, the separator may be of a blade in the shape of a plate.

In the above-described embodiments, the pressure roller 51 is illustrated as an example of the pressure member; however, the pressure member may be a member including a belt and a pad.

In the above-described embodiments, the foil film F is configured to have four layers. However, the foil film may consist of any number of layers including a transfer layer and a supporting layer.

The elements described in the above embodiments and modified examples may be implemented selectively and in combination.

What is claimed is:

1. A foil transfer device for transferring a foil-containing transfer layer from a foil film having the transfer layer, onto a sheet laid on the foil film, the foil transfer device comprising:

a supply reel on which a foil film is wound and which is configured to supply the foil film;

a take-up reel on which to take up the foil film;

a heating member configured to heat the foil film;

a pressure member configured to press the foil film and the sheet between the pressure member and the heating member;

a separator configured to change a direction of travel of the foil film having passed through between the heating member and the pressure member, into a direction different from a direction of conveyance of the sheet, to thereby separate the foil film from the sheet; and a first fan configured to blow air toward the foil film positioned between the heating member and the separator.

2. The foil transfer device according to claim 1, wherein the first fan is configured to blow air toward a surface of the foil film for the sheet to be laid thereon.

3. The foil transfer device according to claim 2, further comprising:

a housing main body having an opening; and a film cartridge installable in and removable from the housing main body through the opening, wherein the film cartridge includes the supply reel and the take-up reel.

4. The foil transfer device according to claim 3, wherein the opening faces upward.

5. The foil transfer device according to claim 4, further comprising a cover configured to openably close the opening, wherein the cover includes the first fan.

6. The foil transfer device according to claim 5, wherein the cover has a side surface provided with an air intake, and wherein the first fan is configured to blow air taken in through the air intake, to the housing main body.

7. The foil transfer device according to claim 1, wherein the first fan is located upstream of the heating member in the direction of conveyance of the sheet.

8. The foil transfer device according to claim 1, further comprising a first duct through which to guide air forced out from the first fan, the first duct having an air outlet formed therein, the air outlet extending across a width of the foil film.

9. The foil transfer device according to claim 1, further comprising a second fan configured to force out air around the foil film positioned between the heating member and the separator.

10. The foil transfer device according to claim 9, wherein the second fan is an axial fan.

11. The foil transfer device according to claim 9, further comprising:

a power supply board; and a second duct through which to guide air around the power supply board to the second fan.

12. The foil transfer device according to claim 1, further comprising a first temperature detector capable of detecting a temperature of the heating member, wherein the first temperature detector is located in a position behind the foil film such that the foil film overlaps the first temperature detector when an upper side of the foil film positioned between the heating member and the separator on which the sheet is to be laid is viewed straight on in a direction perpendicular thereto.

13. The foil transfer device according to claim 12, wherein the first temperature detector includes a thermostat.

14. The foil transfer device according to claim 12, further comprising a housing main body which allows a first film cartridge and a second film cartridge to be selectively installed therein in a removable manner, the first film cartridge including the supply reel on which a first foil film is wound, and the take-up reel on which to take up the first foil film, the second film cartridge including the supply reel on which a second foil film is wound and the take-up reel on which to take up the second foil film, wherein a position of the first foil film of the first film cartridge installed in the housing main body in an across-the-width direction of the first foil film is different from a position of the second foil film of the second film cartridge installed in the housing main body in an across-the-width direction of the second foil film, and wherein the position in which the first temperature detector is located is such that the first foil film overlaps the first temperature detector when the first film cartridge is installed in the housing main body and an upper side of the first foil film positioned between the heating member and the separator is viewed straight on in a direction perpendicular thereto, and that the second foil film overlaps the first temperature detector when the second film cartridge is installed in the housing main body and an upper side of the second foil film positioned between the heating member and the separator is viewed straight on in a direction perpendicular thereto.

15. The foil transfer device according to claim 1, further comprising a second temperature detector capable of detecting a temperature of the heating member, wherein the second temperature detector is located upstream of the heating member and the pressure member in the direction of conveyance of the sheet.

16. The foil transfer device according to claim 15, wherein the second temperature detector includes a thermistor capable of detecting a temperature for use in regulating an electric current to be passed through the heating member.

17. The foil transfer device according to claim 16, wherein the second temperature detector includes:

a first thermistor located in a first position in an across-the-width direction of the foil film; and a second thermistor located in a second position in the across-the-width direction of the foil film, the second position being different from the first position.

18. The foil transfer device according to claim 1, wherein the heating member is a heating roller, and wherein the transfer layer is transferred onto a toner image formed on the sheet.

19. The foil transfer device according to claim 1, further comprising:

a third temperature detector capable of detecting a temperature of the separator; and a controller, wherein the controller is configured to execute a first cooldown process to cool the separator down if a temperature acquired from the third temperature detector is equal to or higher than a first temperature.

20. The foil transfer device according to claim 19, wherein the controller is configured to monitor the temperature acquired from the third temperature detector after starting the first cooldown process, and to bring the first cooldown process to an end on condition that the temperature acquired from the third temperature detector has become lower than a second temperature, the second temperature being lower than the first temperature.

21. The foil transfer device according to claim 19, wherein the controller is configured to reduce an amount of conveyance of the sheet per unit time in the first cooldown process.

22. The foil transfer device according to claim 19, further comprising:

a housing configured to accommodate the heating member and the separator; and a fan capable of forcing air within the housing to flow, wherein the first cooldown process executed by the controller includes causing the fan to revolve at a first speed.

23. The foil transfer device according to claim 22, wherein the controller is configured to cause the fan to revolve at a second speed slower than the first speed before the temperature acquired from the third temperature detector has become equal to or higher than the first temperature.

24. The foil transfer device according to claim 23, wherein the controller is configured to cause the fan to revolve at the second speed if the temperature acquired from the third temperature detector is equal to or higher than a third temperature, the third temperature being lower than the first temperature.

25. The foil transfer device according to claim 19, further comprising a second temperature detecting device capable of detecting a temperature of the heating member, wherein the controller is configured to execute a second cooldown process to cool the heating member down if a temperature acquired from the second temperature detector is equal to or higher than a fourth temperature, the fourth temperature being higher than the first temperature.

26. The foil transfer device according to claim 19, wherein the third temperature detector is a thermistor in contact with the separator.

27. The foil transfer device according to claim 26, wherein the separator includes a shaft of stainless steel, and a cover of plastic, the shaft being covered with the cover.

28. The foil transfer device according to claim 19, wherein the third temperature detector is located in a position within a region coextensive, in an axial direction of the separator, with a path of a foil transferable minimum-sized sheet allowed to be conveyed in the foil transfer device.

29. The foil transfer device according to claim 19, further comprising a contact/separation mechanism configured to cause the heating member and the foil film selectively to be in contact with and to be separate from each other, wherein the controller is configured to execute the first cooldown process in a state where the heating member is separate from the foil film.

* * * * *